US010642219B2

(12) United States Patent
Sato

(10) Patent No.: US 10,642,219 B2
(45) Date of Patent: May 5, 2020

(54) IMAGE FORMING APPARATUS WITH A REFEEDING PATH HAVING VERTICAL AND HORIZONTAL REFEEDING PATHS

(71) Applicant: BROTHER KOGYO KABUSHIKI KAISHA, Nagoya-shi, Aichi-ken (JP)

(72) Inventor: Shougo Sato, Seto (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/238,728

(22) Filed: Jan. 3, 2019

(65) Prior Publication Data

US 2019/0137929 A1 May 9, 2019

Related U.S. Application Data

(63) Continuation of application No. 15/447,461, filed on Mar. 2, 2017, now Pat. No. 10,175,644, which is a (Continued)

(30) Foreign Application Priority Data

Aug. 22, 2014 (JP) ..... 2014-169804
Nov. 28, 2014 (JP) ..... 2014-241001

(51) Int. Cl.
*G03G 21/18* (2006.01)
*G03G 15/00* (2006.01)

(52) U.S. Cl.
CPC ..... *G03G 21/1857* (2013.01); *G03G 15/757* (2013.01)

(58) Field of Classification Search
CPC ..... G03G 21/1857; G03G 15/757; G03G 15/6579; G03G 15/6502; G03G 15/6505
See application file for complete search history.

(56) References Cited

U.S. PATENT DOCUMENTS 5,903,803 A 5/1999 Kawai et al.
5,930,562 A 7/1999 Noda et al.
(Continued)

FOREIGN PATENT DOCUMENTS

JP 3-328449 A 12/1996
JP 10-20602 A 1/1998
(Continued)

*Primary Examiner* — Walter L Lindsay, Jr.
*Assistant Examiner* — Arlene Heredia
(74) *Attorney, Agent, or Firm* — Merchant & Gould P.C.

(57) ABSTRACT

There is provided an image forming apparatus including a main body and a cartridge having an image carrier and a first coupling configured to rotate the image carrier. The main body includes a second coupling, a rotator and a receiving member. The second coupling is configured to rotate together with the first coupling about a rotation axis coaxially with the first coupling. The rotator includes gear teeth. The rotator is configured to rotate the second coupling in response to receiving the drive force from the drive source, and to rotate together with the second coupling about the rotation axis coaxially with the second coupling. The rotator, which is configured to rotate about the rotation axis coaxially with the first coupling configured to rotate the image carrier, overlaps with the receiving member when viewed from an axial direction parallel to the rotation axis.

20 Claims, 14 Drawing Sheets

Related U.S. Application Data continuation of application No. 14/825,674, filed on Aug. 13, 2015, now Pat. No. 9,588,477.

(56) References Cited

U.S. PATENT DOCUMENTS

| | | | | |
|---|---|---|---|---|
| 2002/0018666 | A1 | 2/2002 | Noda et al. | |
| 2003/0223779 | A1 | 12/2003 | Matsubara | |
| 2003/0235449 | A1* | 12/2003 | Ahn | G03G 15/232 399/401 |
| 2005/0260010 | A1 | 11/2005 | Yokota | |
| 2007/0147883 | A1 | 6/2007 | Sato et al. | |
| 2013/0259529 | A1 | 10/2013 | Yamamoto | |
| 2013/0302069 | A1 | 11/2013 | Kamimura et al. | |
| 2014/0064814 | A1* | 3/2014 | Sato | G03G 15/234 399/388 |
| 2015/0063890 | A1 | 3/2015 | Fujita | |

FOREIGN PATENT DOCUMENTS

| | | | |
|---|---|---|---|
| JP | 10-39715 | A | 2/1998 |
| JP | 10-74031 | A | 3/1998 |
| JP | 10-104997 | A | 4/1998 |
| JP | 10-240103 | A | 9/1998 |
| JP | 2000-330455 | A | 11/2000 |
| JP | 2002-040875 | A | 2/2002 |
| JP | 2002-156004 | A | 5/2002 |
| JP | 2004-004959 | A | 1/2004 |
| JP | 2005-338146 | A | 12/2005 |
| JP | 2007-86665 | A | 4/2007 |

* cited by examiner

IMAGE FORMING APPARATUS WITH A REFEEDING PATH HAVING VERTICAL AND HORIZONTAL REFEEDING PATHS

CROSS-REFERENCE TO RELATED APPLICATION

This application is a continuation of U.S. patent application Ser. No. 15/447,461 filed Mar. 2, 2017, which is a continuation of U.S. patent application Ser. No. 14/825,674, filed Aug. 13, 2015, all of which further claim priority from Japanese Patent Application No. 2014-169804, filed Aug. 22, 2014, and Japanese Patent Application No. 2014-241001, filed Nov. 28, 2014. The contents of the above are incorporated herein by reference in their entirety.

FIELD OF DISCLOSURE

The disclosure relates to an electrophotographic image forming apparatus.

BACKGROUND

A known electrophotographic image forming apparatus includes a main body and an image carrier disposed in the main body and configured to carry a developer image thereon.

The image forming apparatus includes a main body, and a process cartridge including a photosensitive drum. The process cartridge is configured to be mounted onto and removed from the main body. The process cartridge includes a coupling device. The main body includes a main body coupling device configured to engage the coupling device of the process cartridge.

In the image forming apparatus, the main body coupling device includes a coupling recessed shaft configured to engage the coupling device of the process cartridge, and a large gear integrally formed with the coupling recessed shaft. Drive force from a motor is configured to be input to the large gear and transmitted to the coupling device of the process cartridge, via the coupling recessed shaft.

SUMMARY

Further reduction of a physical size of the image forming apparatus may be required.

According to one or more aspects of the disclosure, an image forming apparatus may include a main body and a cartridge. The main body may include a drive source. The cartridge may include an image carrier configured to carry a developer image thereon, and a first coupling configured to rotate the image carrier. The cartridge may be configured to be mounted to and removed from the main body. The main body may include a second coupling, a rotator, and a receiving member. The second coupling may be configured to engage with and disengage from the first coupling. The second coupling may be configured to rotate together with the first coupling about a rotation axis coaxially with the first coupling when the second coupling engages with the first coupling. The rotator may include gear teeth disposed on a peripheral surface thereof. The rotator may be configured to rotate the second coupling in response to receiving the drive force from the drive source, and to rotate together with the second coupling about the rotation axis coaxially with the second coupling. The receiving member may be configured to receive a recording medium discharged outside the main body. The rotator, which may be configured to rotate about the rotation axis coaxially with the first coupling configured to rotate the image carrier, may overlap with the receiving member when viewed from an axial direction parallel to the rotation axis.

According to one or more other aspects of the disclosure, an image forming apparatus may include a main body and a cartridge. The main body may include a drive source. The cartridge may include an image carrier configured to carry a developer image thereon, and a first coupling configured to rotate the image carrier. The cartridge may be configured to be mounted to and removed from the main body. The main body may include a second coupling, a rotator, and a receiving member. The second coupling may be configured to engage with and disengage from the first coupling. The second coupling may be configured to rotate together with the first coupling about a rotation axis coaxially with the first coupling when the second coupling engages with the first coupling. The rotator may include gear teeth disposed on a peripheral surface thereof. The rotator may be configured to rotate the second coupling in response to receiving the drive force from the drive source, and to rotate together with the second coupling about the rotation axis coaxially with the second coupling. The receiving member may be configured to receive a recording medium discharged outside the main body. The receiving member may include a receiving wall and a side wall. The receiving wall may be configured to receive the recording medium discharged outside the main body. The side wall may be disposed further outward in an axial direction parallel to the rotation axis with respect to the receiving wall, and may be configured to regulate a position of the recording medium received on the receiving wall in the axial direction. The rotator, which may be configured to rotate about the rotation axis coaxially with the first coupling configured to rotate the image carrier, may be disposed opposite to the receiving wall in the axial direction relative to the side wall.

According to one or more other aspects of the disclosure, an image forming apparatus may include a main body and a cartridge. The cartridge may include a rotating member and a first coupling. The rotating member may be configured to carry a developer image thereon. The first coupling may be configured to rotate the rotating member in response to receiving a drive force from the main body, and may be configured to move between an inside position in which the cartridge is positioned inside the main body and an outside position in which the cartridge is positioned outside the main body, in a direction orthogonal to a rotation axis of the rotating member. The main body includes a frame, an opening-closing member, a second coupling, and an interlocking mechanism. The frame may have an opening portion configured to pass the cartridge therethrough. The opening-closing member may be configured to move between an open position in which the opening portion is open and a closed position in which the opening portion is closed. The second coupling may be configured to move between an engaged position to engage with the first coupling and a disengaged position to disengage from the first coupling, in an axial direction parallel to the rotation axis of the rotating member, and may be configured to input the drive force to the first coupling by rotating together with the first coupling when the second coupling engages with the first coupling. The interlocking mechanism may be configured to position the second coupling in the disengaged position in response to movement of the opening-closing member from the closed position to the open position, and may be configured to position the second coupling in the engaged position in response to movement of the opening-closing member from the open position to the closed position. The interlocking mechanism may include a rotation shaft, a first coupling portion, and a second coupling portion. The rotation shaft may extend in the axial direction. The first coupling portion may extend from the rotation shaft in a first direction orthogonal to the rotation shaft, and may be coupled to the opening-closing member. The second coupling portion may extend from the rotation shaft in a second direction orthogonal to the rotation shaft further outward in the axial direction with respect to the first coupling portion, and may be coupled to the second coupling.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

1. General Structure of Image Forming Apparatus

Figure 1:
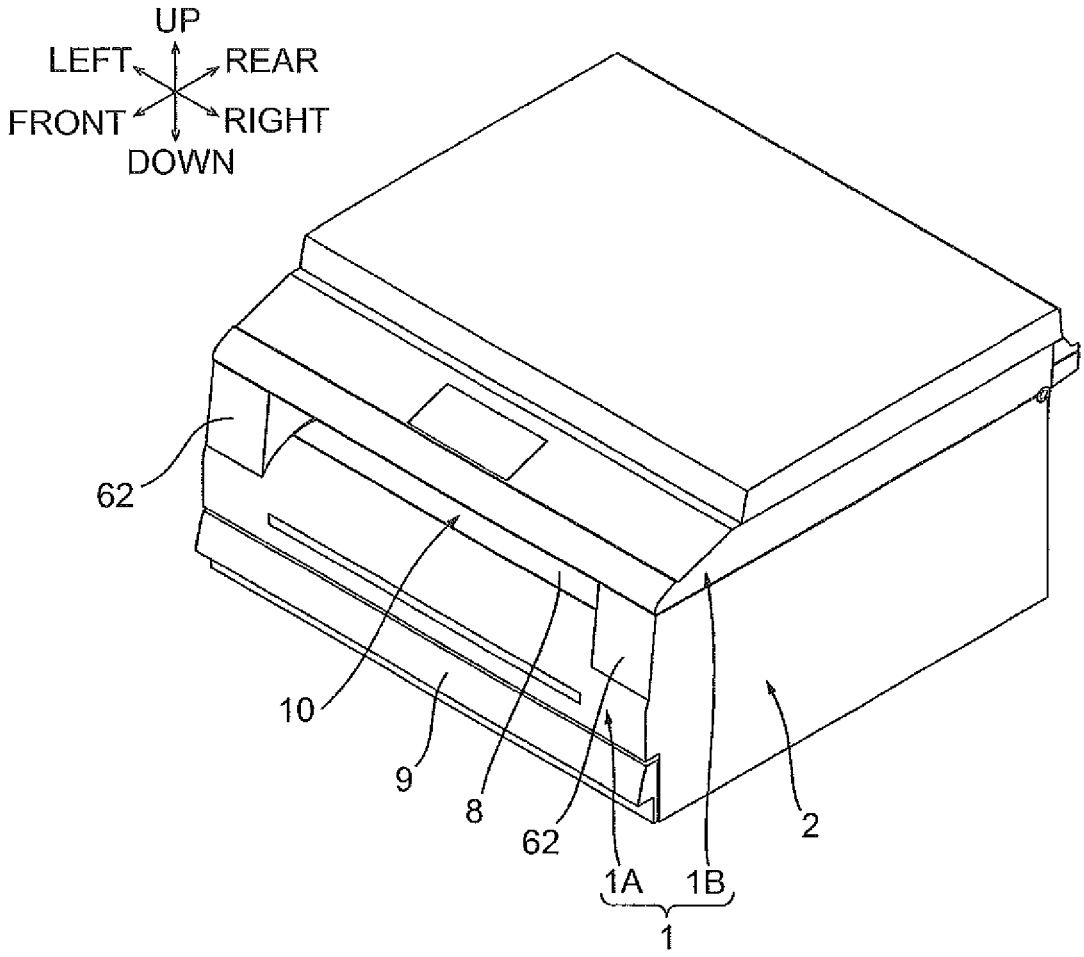
FIG. 1 is a perspective view of a printer as an example of an image forming apparatus in an illustrative embodiment according to one or more aspects of the disclosure.
Figure 2:
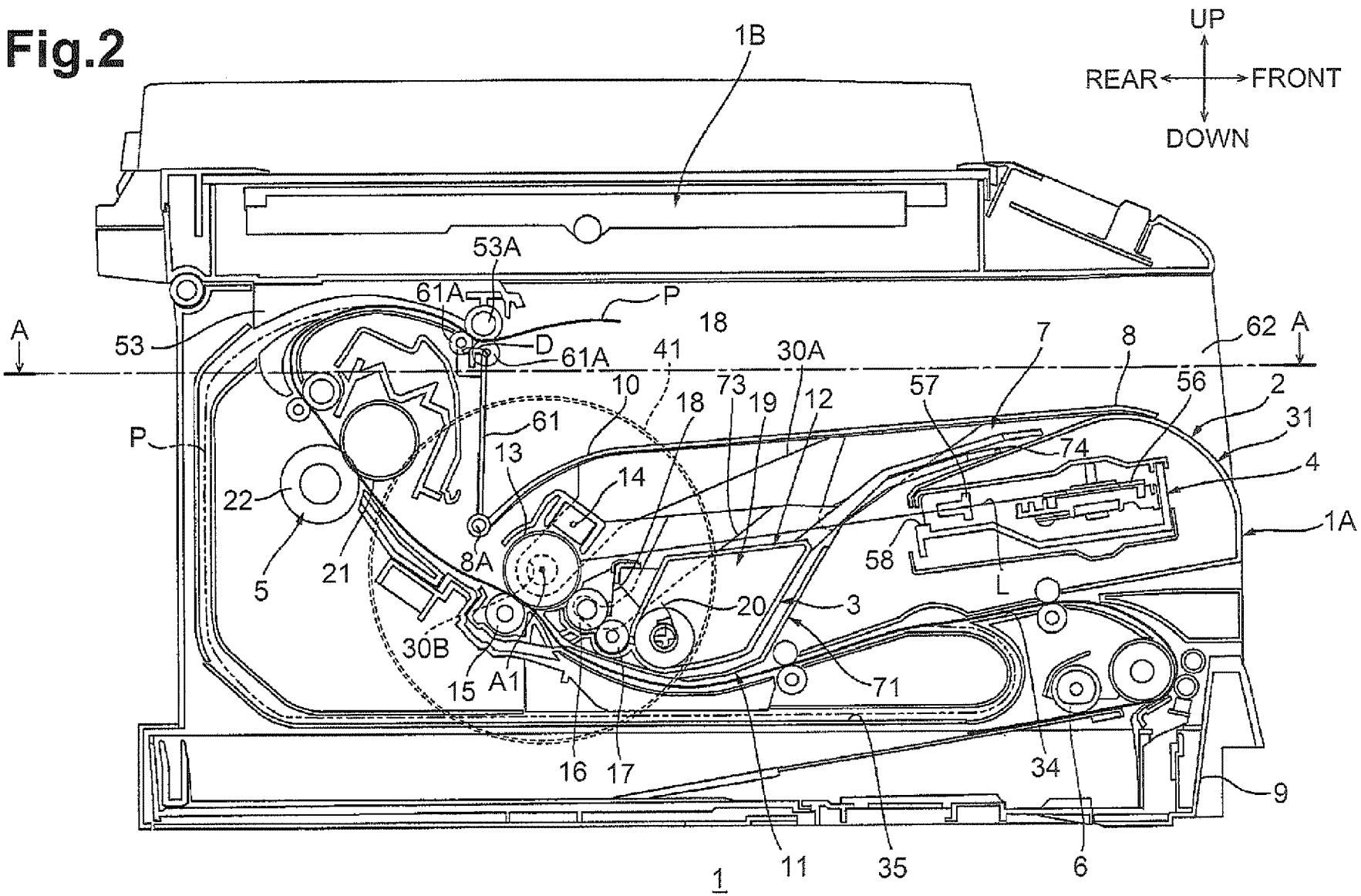
FIG. 2 is a side sectional view of the printer depicted in FIG. 1.

As depicted in FIGS. 1 and 2, an image forming apparatus, e.g., a printer 1, may be an electrophotographic monochrome printer.

In the following description, a top-bottom direction or a vertical direction is defined in conjunction with an orientation in which the printer 1 is placed horizontally. In other words, upper and lower sides in FIG. 2 are defined as upper and lower sides, respectively. Right and left sides in FIG. 2 are defined as front and rear sides, respectively. Left and right sides of the printer 1 are defined when the printer 1 is viewed from the front side. In other words, front and back sides of the sheet of FIG. 2 are defined as left and right sides, respectively. A left-right direction may be an example of an axial direction. A vertical direction may be an example of a direction extending downward from the front to the rear.

The printer 1 includes an image forming unit 1A configured to form, e.g., print, an image on a sheet P, and an image reading portion 1B configured to read an image information on a document.

The image forming unit 1A is disposed at a lower half of the printer 1. The image forming unit 1A includes a main body 2, a cartridge, e.g., a process cartridge 3, an exposure member, e.g., a scanner unit 4, and a fixing unit 5.

The main body 2 has a generally box shape. The main body 2 includes an opening portion, e.g., a main body opening 7, an opening-closing member, e.g., a top cover 8, an accommodating member, e.g., a sheet supply tray 9, a pickup roller 6, a receiving member, e.g., a discharge tray 10.

The main body opening 7 is disposed at a generally central portion of an upper wall of an outer frame 31 (described below) of the main body 2 in the left-right direction to allow an interior and an exterior of the main body 2 to communicate with each other in a vertical direction. The main body opening 7 is configured to allow the process cartridge 3 to pass therethrough.

As will be described in detail later, the top cover 8 is disposed at a generally central portion of the main body 2 in the left-right direction to close the main body opening 7. The top cover 8 has a generally flat plate shape extending in the front-rear direction. The top cover 8 is configured to pivotally move about a rear end portion thereof between an open position (refer to FIG. 9) in which the main body opening 7 is open and a closed position (refer to FIG. 2) in which the main body opening 7 is closed.

The sheet supply tray 9 is disposed at a bottom portion of the main body 2. The sheet supply tray 9 is configured to accommodate a stack of recording mediums, e.g., sheets P.

The pickup roller 6 is disposed at a lower front end portion of the main body 2, above a front end portion of the sheet supply tray 9.

The discharge tray 10 is disposed at an upper end portion of the main body 2. As will be described in detail later, the discharge tray 10 has a generally rectangular frame shape to receive a sheet P. The top cover 8 serves as a bottom wall of the discharge tray 10.

The process cartridge 3 is disposed in a central portion of the main body 2. The process cartridge 3 is configured to move between an inside position (refer to FIG. 2) in which the process cartridge 3 is positioned inside the main body 2 and an outside position (refer to FIG. 9) in which the process cartridge 3 is positioned outside the main body 2, via the main body opening 7. A dimension of the process cartridge 3 in the left-right direction is slightly shorter than a dimension of the main body opening 7 in the left-right direction. The process cartridge 3 includes a drum cartridge 11 and a developing cartridge 12.

The drum cartridge 11 includes a photosensitive drum 13, a scorotron charger 14, and a transfer roller 15. The photosensitive drum 13 is an example of an image carrier or a rotating member.

The photosensitive drum 13 has a generally tubular shape extending in the left-right direction. An axial line A1 of the photosensitive drum 13 may be an example of a rotation axis. The photosensitive drum 13 is disposed at a rear end portion of the drum cartridge 11.

The scorotron charger 14 is disposed diagonally above and to the front of the photosensitive drum 13 with a space between the charger 14 and the drum 13.

The transfer roller 15 is disposed below and to the rear of the photosensitive drum 13. An upper front end portion of the transfer roller 15 is in contact with a lower rear end portion of the photosensitive drum 13.

The developing cartridge 12 is configured to be mounted to and removed from the drum cartridge 11 in front of the photosensitive drum 13. The developing cartridge 12 includes a developing roller 16, a supply roller 17, a layer thickness regulating blade 18, and a toner chamber 19.

The developing roller 16 is disposed at a rear end portion of the developing cartridge 12. An upper rear end portion of the developing roller 16 is in contact with a lower front end portion of the photosensitive drum 13.

The supply roller 17 is disposed below and to the front of the developing roller 16. An upper rear end portion of the supply roller 17 is in contact with a lower front end portion of the developing roller 16.

The layer thickness regulating blade 18 is disposed in front of the developing roller 16. The layer thickness regulating blade 18 is in contact with a front end portion of the developing roller 16.

The toner chamber 19 is disposed in front of the supply roller 17 and the layer thickness regulating blade 18. The toner chamber 19 has a generally box shape. The toner chamber 19 is configured to accommodate developer, e.g., toner. The toner chamber 19 includes an agitator 20.

The agitator 20 is rotatably supported in the toner chamber 19.

The scanner unit 4 is disposed at a front end portion of the main body 2 in front of the process cartridge 3 when the process cartridge 3 is mounted in the main body 2. The scanner unit 4 overlaps with the pickup roller 6 when projected in a vertical direction. The scanner unit 4 is configured to emit laser beam L toward the photosensitive drum 13 based on image data.

The fixing unit 5 is disposed to the rear and above the process cartridge 3 when the process cartridge 3 is mounted in the main body 2. The fixing unit 5 includes a heat roller 21 and a pressure roller 22 pressed against a lower rear end portion of the heat roller 21.

The image reading portion 1B is disposed at an upper half of the printer 1 above the image forming unit 1A, to cover the discharge tray 10 from above. The image reading portion 1B is connected to a rear end portion of the image forming unit 1A, such that the image reading portion 1B pivots about a rear end portion thereof. The image reading portion 1B is configured to read image data on a document.

As the printer 1 starts an image forming operation, the scorotron charger 14 uniformly charges a surface of the photosensitive drum 13. The scanner unit 4 exposes the surface of the photosensitive drum 13. Thus, an electrostatic latent image based on image data is formed on the surface of the photosensitive drum 13.

The agitator 20 agitates toner in the toner chamber 19 and supplies the toner to the supply roller 17. The supply roller 17 supplies the toner supplied by the agitator 20 to the developing roller 16. At this time, the toner is positively charged between the developing roller 16 and the supply roller 17 by friction, and carried on the developing roller 16. The layer thickness regulating blade 18 regulates the thickness of a layer of the toner carried on the developing roller 16 to a constant thickness.

The toner carried on the developing roller 16 is supplied to an electrostatic latent image on the surface of the photosensitive drum 13. Thus, a developer image, e.g., a toner image, is carried on the surface of the photosensitive drum 13.

The sheets P are supplied one by one between the photosensitive drum 13 and the transfer roller 15 at a predetermined timing from the sheet supply tray 9 with the rotation of various rollers, after being picked up by the pickup roller 6. The toner image on the surface of the photosensitive drum 13 is transferred to a sheet P when the sheet P passes between the photosensitive drum 13 and the transfer roller 15.

Thereafter, the sheet P passes between the heat roller 21 and the pressure roller 22, heat and pressure are applied to the sheet P. Thus, the toner image on the sheet P is thermally fixed on the sheet P. Thereafter, the sheet P passes between a discharge roller 61A and an opposing roller 53A, which are described below, and is discharged outside the main body 2, that is, discharged onto a bottom wall of the discharge tray 10, e.g., on the top cover 8 which is positioned in the closed position. The top cover 8 may be an example of a receiving wall.

2. Details of Main Body

Figure 3:
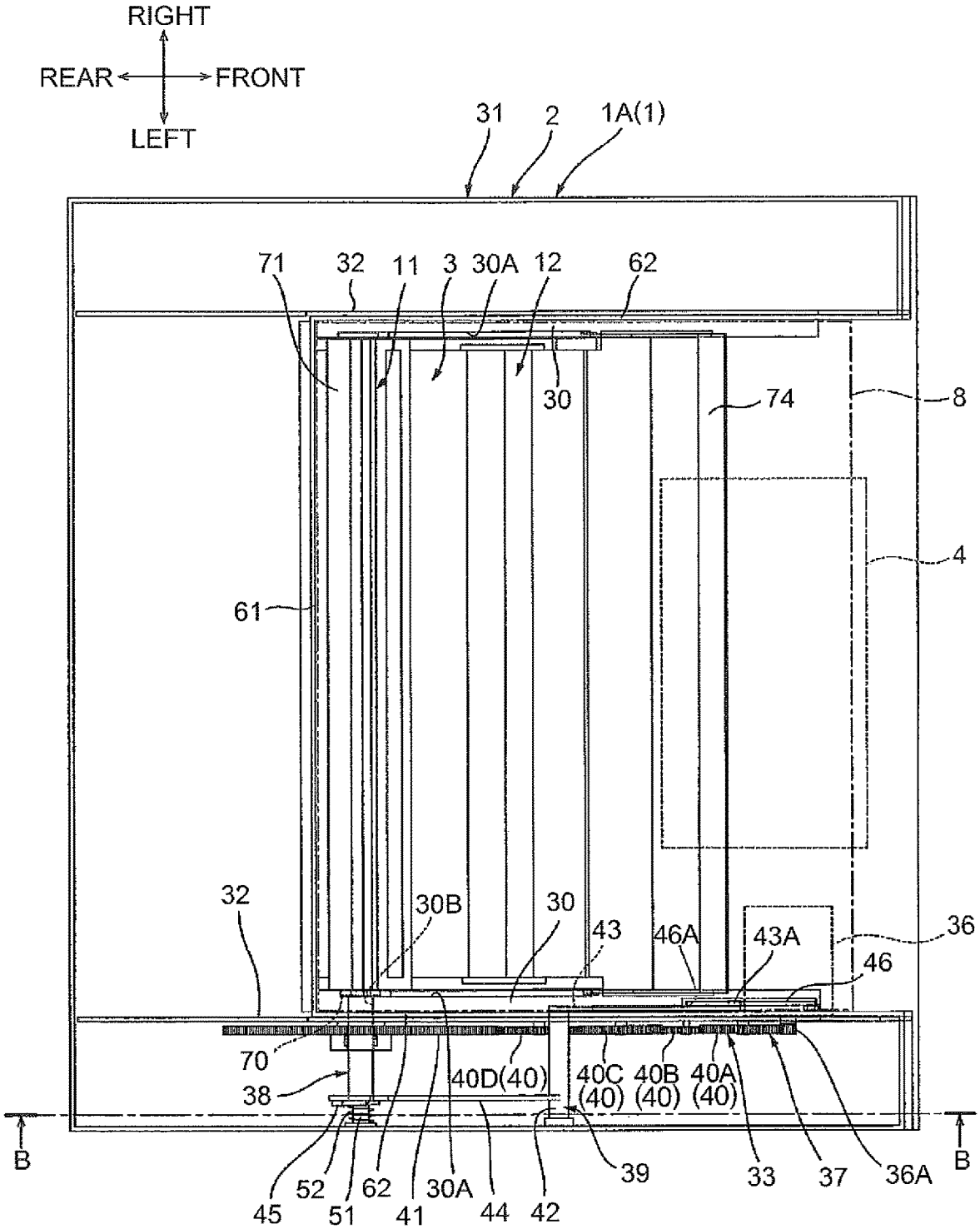
FIG. 3 is a sectional view of the printer, taken along a line A-A in FIG. 2.

As depicted in FIGS. 2 and 3, the main body 2 includes a frame, e.g., an outer frame 31, a pair of side plates 32, a pair of inner frames 30, a sheet feed path 34, a refeeding portion, e.g., a duplex print path 35, and a drive unit 33.

(1) Outer and Inner frames, Sheet Feed Path, and Duplex Print Path

The outer frame 31 defines an exterior of the image forming unit 1A. The outer frame 31 has a generally box shape. The outer frame 31 includes rigid resin. The outer frame 31 includes the discharge tray 10, a discharge guide 53, a main body coupling supporting shaft 51, and a compression spring 52.

The discharge tray 10 includes a partition wall, e.g., a rear wall 61, a pair of side walls 62, and the top cover 8.

The rear wall 61 is disposed in front of the fixing unit 5. The rear wall 61 has a generally flat plate shape extending in a vertical direction. The rear wall 61 includes a discharge roller 61A.

The discharge roller 61A is rotatably supported at an upper end portion of the rear wall 61.

Each of the side walls 62 is disposed at a corresponding end portion of the main body 2 in the left-right direction to define the main body opening 7 in the left-right direction. Each side wall 62 has a generally flat plate shape. An upper portion of each side wall 62 contacts a lower surface of the image reading portion 1B. A rear end portion of each side wall 62 continues to a corresponding end portion of the rear wall 61 in the left-right direction. Each side wall 62 is configured to regulate a position of a sheet P discharged onto the top cover 8 with respect to the left-right direction.

The top cover 8 is disposed between the side walls 62. As described above, the top cover 8 has a generally flat plate shape extending in the front-rear direction. The top cover 8 is supported by a lower end portion of the rear wall 61 such that the top cover 8 pivots about a pivot shaft 8A disposed at a rear end portion thereof. The top cover 8 is disposed below the image reading portion 1B with a space therebetween. The top cover 8 serves as a bottom wall of the discharge tray 10 when the top cover 8 is positioned in the closed position. A dimension of the top cover 8 in the left-right direction is similar to the dimension of the main body opening 7 in the left-right direction, and is slightly longer than the dimension of the process cartridge 3 in the left-right direction. The top cover 8 includes an engaging portion 8B.

The engaging portion 8B protrudes downward from a lower surface of the front end portion of the top cover 8. The engaging portion 8B is a plate having a generally toric shape in side view.

The discharge guide 53 is disposed above the fixing unit 5 with a space therebetween, as depicted in FIG. 2. A lower edge of the discharge guide 53 has a generally arc shape curving concavely. The discharge guide 53 is fixed to the lower surface of the image reading portion 1B. A front end portion of the discharge guide 53 is disposed above an upper end portion of the rear wall 61 with a space D therebetween. The space D between a front lower end portion of the discharge guide 53 and the upper end portion of the rear wall 61 may be an example of an opening. The discharge guide 53 includes the opposing roller 53A.

The opposing roller 53A is rotatably supported at a front end portion of the discharge guide 53. The opposing roller 53A is in contact with an upper end portion of the discharge roller 61A.

Figure 4:
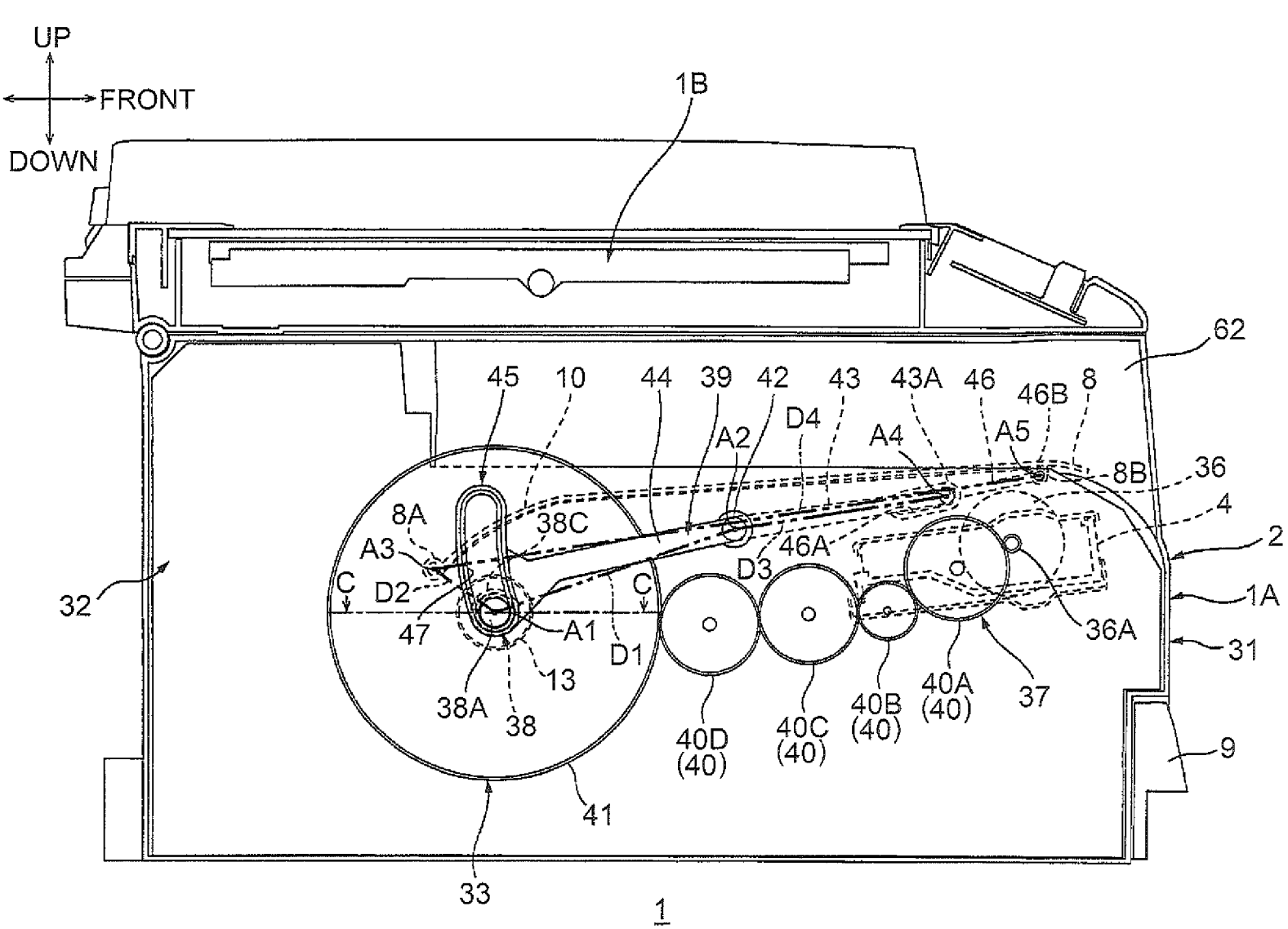
FIG. 4 is a sectional view of the printer, taken along a line B-B in FIG. 3.
Figure 5:
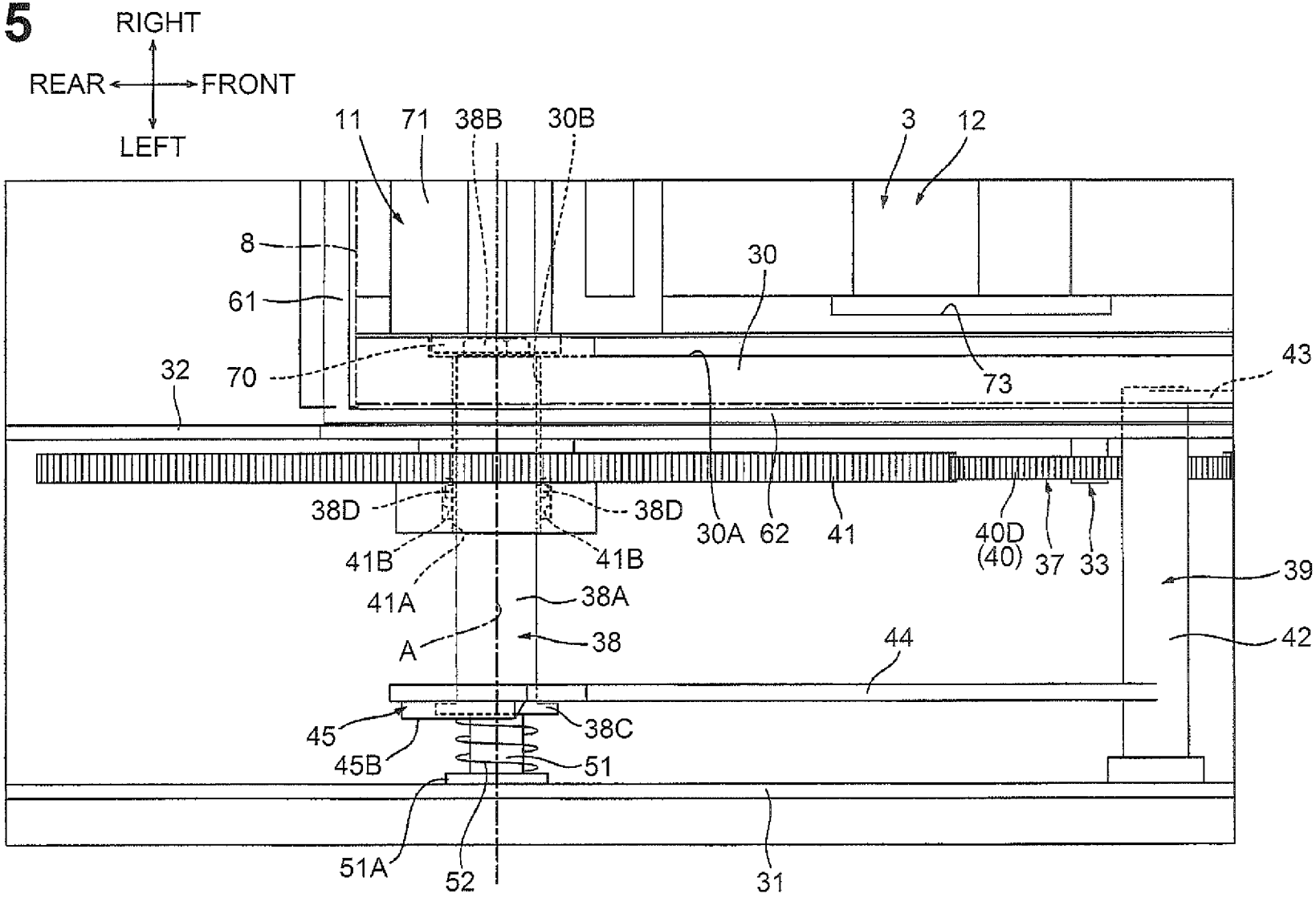
FIG. 5 is an enlarged view of a particular portion depicted in FIG. 3 in which a main body coupling in an extended position.

The main body coupling supporting shaft 51, as depicted in FIG. 5, is disposed below and to the front of a rear end portion of the top cover 8. As depicted in FIG. 4, the main body coupling supporting shaft 51 has a generally cylindrical shape extending rightward from an inner surface (e.g., a right surface) of a left wall of the outer frame 31. The main body coupling supporting shaft 51 includes a flange portion 51A.

The flange portion 51A is disposed at a left end portion of the main body coupling supporting shaft 51. The flange portion 51A has a generally plate shape protruding outward from an outer peripheral surface of a left end portion of the main body coupling supporting shaft 51 in a radial direction thereof and extending in a circumferential direction of the main body coupling supporting shaft 51. The left surface of the flange portion 51A is in contact with an inner surface (e.g., a right surface) of the left wall of the outer frame 31.

The compression spring 52 may be a compression coil spring extending in the left-right direction. The compression spring 52 is disposed around the main body coupling supporting shaft 51. A left end portion of the compression spring 52 is in contact with a right surface of the flange portion 51A of the main body coupling supporting shaft 51. A right end of portion the compression spring 52 is in contact with a left surface (refer to FIG. 12A) of a flange portion 38C of a main body coupling 38 (described below). The compression spring 52 is compressed between the flange portion 51A of the main body coupling supporting shaft 51 and the flange portion 38C of the main body coupling 38 (described below). Thus, the compression spring 52 biases the main body coupling 38 (described below) rightward constantly.

Each of the side plates 32 is disposed closer to the center of the main body 2 in the left-right direction than a corresponding side wall of the outer frame 31, with a space therebetween, as depicted in FIGS. 3 and 5. Each side plate 32 has a generally flat plate shape extending in the front-rear direction. Each side plate 32 includes metal, e.g., iron and stainless steel, having high rigidity.

Each of the inner frames 30 is supported by an inner surface of a corresponding side plate 32 in the left-right direction. Each inner frame 30 has a thickness in the left-right direction. Each inner frame 30 has a generally frame shape with an inner end portion thereof in the left-right direction closed. Each of the inner frames 30 includes rigid resin. An outer end portion of each inner frame 30 is closed by a corresponding side plate 32. Thus, a space is defined between an inner wall of each inner frame 30 in the left-right direction and a corresponding side plate 32. Each inner frame 30 includes a drum guide groove 30A. A left inner frame 30 has a main body coupling insertion hole 30B.

As depicted in FIGS. 2 and 5, the drum guide groove 30A is disposed at a rear portion of an inner frame 30. The drum guide groove 30A is recessed outward in the left-right direction from an inner surface of the inner frame 30 in the left-right direction. The drum guide groove 30A extends downward from the front to the rear. The drum guide groove 30A has a generally "V" shape in side view with an upper end portion thereof open.

The main body coupling insertion hole 30B is disposed at a rear portion of the drum guide groove 30A. The main body coupling insertion hole 30B has a generally circular shape in side view. The main body coupling insertion hole 30B passes through a right wall of the left inner frame 30 in the left-right direction. The diameter of the main body coupling insertion hole 30B is greater than the outside diameter of a shaft portion 38A of the main body coupling 38 (described below).

As depicted in FIG. 2, a front end portion of the sheet feed path 34 is disposed between the scanner unit 4 and the sheet supply tray 9. The sheet feed path 34 extends upward and rearward while curving from a portion above a front end portion of the sheet supply tray 9, and then extends generally linearly to the rear. A sheet P in the sheet supply tray 9 is supplied between the photosensitive drum 13 and the transfer roller 15 through the sheet feed path 34.

The duplex print path 35 extends downward from a portion below a rear end portion of the discharge guide 53 and then frontward through a portion between the process cartridge 3 and the sheet supply tray 9. The duplex print path 35 curves upward behind the pickup roller 6 and joins or continues to a portion of the sheet feed path 34. When a duplex print mode, in which each side of a sheet P is printed, is selected in the above-described image forming operation, a sheet P passing through the fixing unit 5 is resupplied to the sheet feed path 34 through the duplex print path 35.

(2) Drive Unit

As depicted in FIGS. 3 and 4, the drive unit 33 is disposed at a left end portion of the image forming unit 1A. The drive unit 33 includes a drive source, e.g., a motor 36, a gear train 37, a connecting member, e.g., a link member 46, a cam 39, and a second coupling, e.g., a main body coupling 38.

The motor 36 is disposed to the left of the scanner unit 4. The motor 36 is supported at a right surface of the left side plate 32. In one example, the motor 36 is disposed overlapping with the scanner unit 4 when projected in the left-right direction. The motor 36 is disposed overlapping with a left front end portion of the top cover 8 when projected in a vertical direction. A rotation shaft of the motor 36 passes through the left side plate 32 in the left-right direction and protrudes more leftwards than the left side plate 32. The motor 36 includes a pinion gear 36A.

The pinion gear 36A is disposed to the left of the left side plate 32. The pinion gear 36A is supported by a left end portion of the rotation shaft of the motor 36 to rotate together with the rotation shaft of the motor 36. The pinion gear 36A includes gear teeth formed around a peripheral surface thereof.

The gear train 37 is disposed between the left side plate 32 and the left wall of the outer frame 31. The gear train 37 is disposed to allow drive force from the motor 36 to be transmitted to the main body coupling 38. In one example, the gear train 37 includes a rotator, e.g., a drum drive gear 41, and a plurality of idle gears 40.

Figure 6:
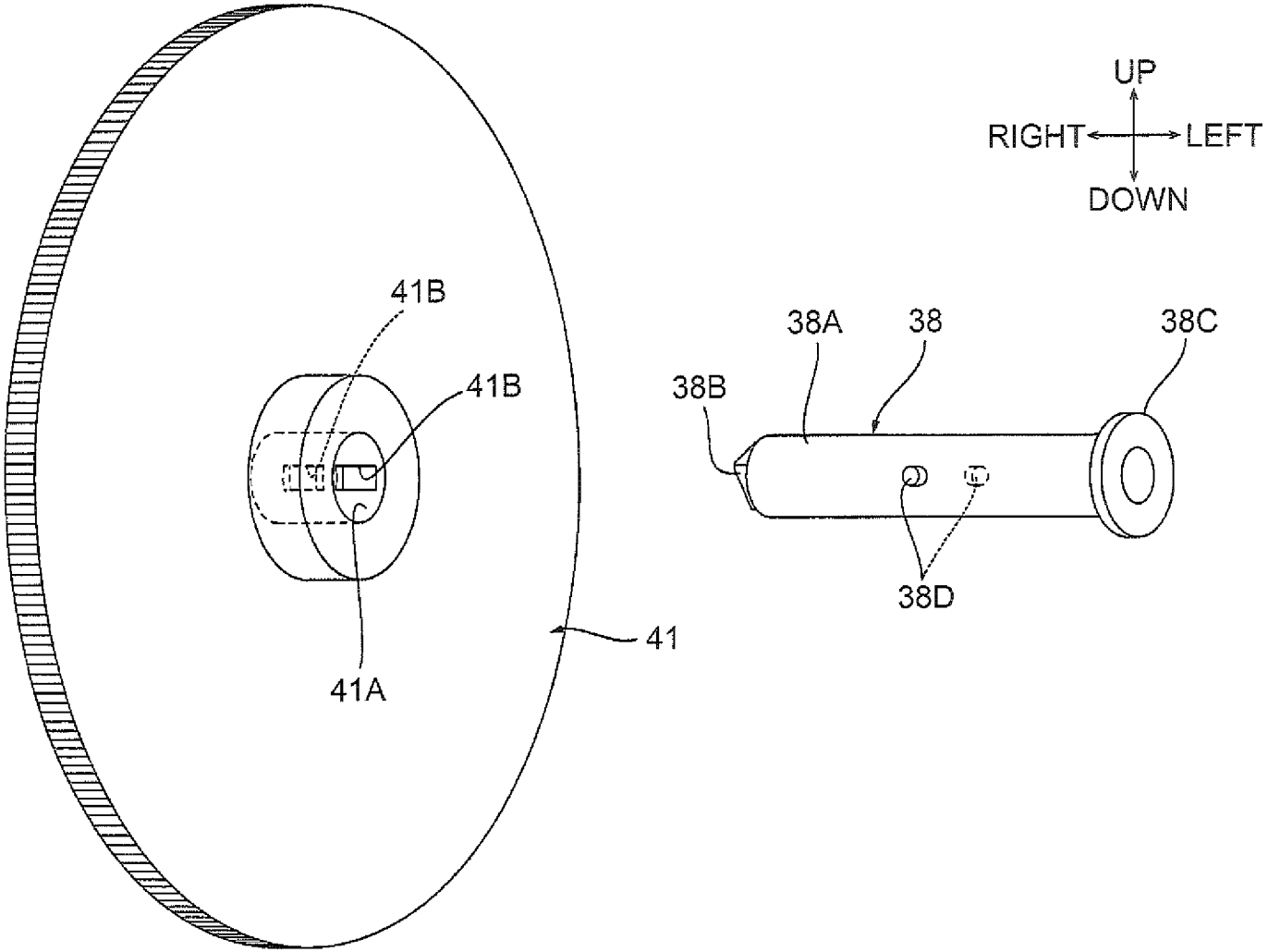
FIG. 6 is an exploded perspective view of a drum drive gear and the main body coupling depicted in FIG. 5.

As depicted in FIGS. 4 and 5, the drum drive gear 41 is disposed at a generally central portion of the main body 2 in the front-rear direction. The main body coupling 38 is inserted into a central portion of the drum drive gear 41 in a radial direction thereof. The drum drive gear 41 is disposed to the left of a left side wall 62 of the discharge tray 10. The drum drive gear 41 has a generally disc shape. The drum drive gear 41 includes gear teeth formed around a peripheral surface thereof. The diameter of an addendum circle of the drum drive gear 41 is greater than the diameter of the photosensitive drum 13. The diameter of an addendum circle of the drum drive gear 41 may be at least, for example, 3 times as large as the diameter of the photosensitive drum 13, but, for example, 10 times or less. An upper end portion of the drum drive gear 41 overlaps with the pivot shaft 8A of the top cover 8 and a lower end portion of the rear wall 61 when projected in the left-right direction. For example, an upper end portion of the drum drive gear 41 overlaps with a rear end portion of the discharge tray 10 when projected in the left-right direction. As depicted in FIG. 2, a lower end portion of the drum drive gear 41 overlaps with a generally central portion of the duplex print path 35 and the sheet supply tray 9 in the front-rear direction when projected in the left-right direction. The drum drive gear 41 includes an insertion hole 41A and recess portions 41B, as depicted in FIGS. 5 and 6.

The insertion hole 41A is disposed at a central portion of the drum drive gear 41 in a radial direction of the gear 41. The insertion hole 41A passes through the drum drive gear 41 in the left-right direction. The insertion hole 41A has a generally circular shape in side view. The diameter of the insertion hole 41A is approximately equal to the outside diameter of the main body coupling 38.

A recess portion 41B is disposed at front and rear portions of an inner surface of the insertion hole 41A. The recess portion 41B may be a groove extending in the left-right direction. Each recess portion 41B is recessed outward in the front-rear direction from a corresponding one of front and rear portions of the inner surface of the insertion hole 41A.

Each of the idle gears 40 is disposed between the pinion gear 36A of the motor 36 and the drum drive gear 41, as depicted in FIG. 3. In one example, the plurality of idle gears 40 includes a first idle gear 40A that engages the pinion gear 36A, a second idle gear 40B that engages the first idle gear 40A, a third idle gear 40C that engages the second idle gear 40B, and a fourth idle gear 40D that engages the third idle gear 40C and the drum drive gear 41. The first to fourth idle gears 40A-40D are arranged linearly in this order from the front to the rear. Each idle gear 40 has a generally disc shape. Each idle gear 40 includes gear teeth formed around a peripheral surface thereof.

As depicted in FIGS. 3 and 4, the link member 46 is disposed at a left front end portion of the main body 2. The link member 46 has a generally flat plate shape extending in the front-rear direction. The link member 46 includes a second connecting portion, e.g., an elongated hole 46A, and a first connecting portion, e.g., a boss 46B.

The elongated hole 46A is disposed at a rear end portion of the link member 46. The elongated hole 46A passes through the link member 46 in the left-right direction and extends in the front-rear direction.

The boss 46B is disposed in a front end portion of the link member 46. The boss 46B has a generally cylindrical shape extending leftward from a left surface of the link member 46. The boss 46B rotatably engages with the engaging portion 8B of the top cover 8. Thus, the link member 46 is pivotally supported at the front end portion thereof by a left front end portion of the lower surface of the top cover 8. For example, the link member 46 is disposed to the right of the left side wall 62 of the discharge tray 10 such that the link member 46 overlaps with a front left end portion of the top cover 8 when projected in a vertical direction.

Figure 7:
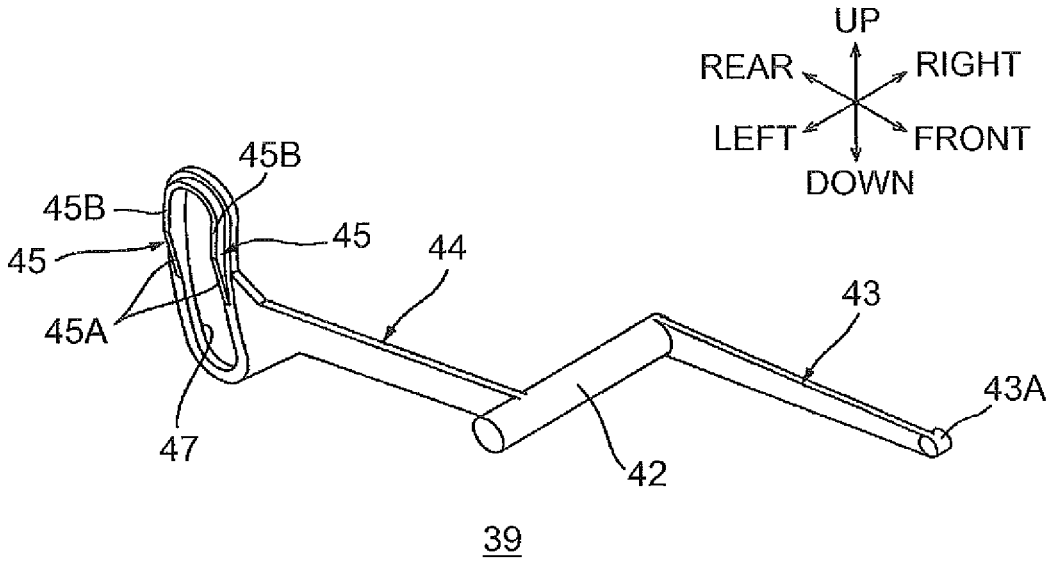
FIG. 7 is a perspective view of a cam depicted in FIG. 5.

As depicted in FIG. 3, the cam 39 is disposed at a left end portion of the main body 2. The cam 39 has a generally crank shape extending in the front-rear direction, as depicted in FIGS. 3 and 7. The cam 39 is configured to move between a release position (refer to FIG. 4) in which the cam 39 extends in the front-rear direction, and a pressing position (refer to FIG. 10) in which the cam 39 extends downward from the front to the rear. The cam 39 and the link member 46 constitute an interlocking mechanism. The cam 39 includes a rotation shaft 42, a first arm 43 and a second arm 44. The first arm 43 is an example of a first coupling portion. The second arm 44 is an example of a second coupling portion.

The rotation shaft 42 is disposed at a generally central portion of the cam 39 in the front-rear direction. The rotation shaft 42 has a generally cylindrical shape extending in the left-right direction. The rotation shaft 42 is supported between the left wall of the outer frame 31 and the left side plate 32 at a position in front of the drum drive gear 41 and above the fourth idle gear 40D, such that the rotation shaft 42 does not overlap with the drum drive gear 41 when projected in the left-right direction. In one example, a left end portion of the rotation shaft 42 is rotatably supported by the left wall of the outer frame 31 and a right end portion of the rotation shaft 42 is rotatably supported by the left side plate 32. A right end portion of the rotation shaft 42 passes through the left side plate 32 and protrudes into an interior space of the left inner frame 30. A distance D1 between an axial line A2 of the rotation shaft 42 and an axial line of the main body coupling 38 is longer than a distance D2 between an axial line A3 of the pivot shaft 8A of the top cover 8 and the axial line of the main body coupling 38. The axial line A2 of the rotation shaft 42 may be an example of a rotation axis of the rotation shaft 42. The axial line of the main body coupling 38 may be an example of a rotation axis of the main body coupling 38. As will be described below, the axial line of the main body coupling 38 matches the axial line A1 of the photosensitive drum 13.

The first arm 43 has a generally linear flat plate shape in side view. A direction in which the first arm 43 extends may be an example of a first direction. The first arm 43 extends forward from a right end portion of the rotation shaft 42. The first arm 43 is disposed in an interior space of the left inner frame 30. The first arm 43 overlaps with a front left end portion of the top cover 8 when projected in a vertical direction. For example, the first arm 43 is disposed to the right of the left side wall 62 of the discharge tray 10. The first arm 43 includes a connecting boss 43A.

The connecting boss 43A is disposed at a front end portion of the first arm 43. The connecting boss 43A has a generally cylindrical shape protruding rightward from a right surface of the first arm 43. The connecting boss 43A slidably engages in the elongated hole 46A of the link member 46. Thus, the first arm 43 is coupled to the top cover 8 via the ling member 46. A distance D3 between an axial line A4 of the connecting boss 43A and the axial line A2 of the rotation shaft 42 is shorter than a distance D4 between the axial line A3 of the pivot shaft 8A of the top cover 8 and an axial line A5 of the engaging portion 8B of the top cover 8.

The second arm 44 has a generally flat plate shape and a generally "L" shape in side view. A direction in which the second arm 44 extends may be an example of a second direction. The second arm 44 extends rearward from a left end portion of the rotation shaft 42. The second arm 44 is disposed to the right of the left wall of the outer frame 31 and to the left of the gear train 37. The second arm 44 has a through hole 47 and a displacing portion, e.g., a pair of movable portion 45.

The through hole 47 is disposed at a rear end portion of the second arm 44. The through hole 47 passes through a rear end portion of the second arm 44 in the left-right direction. The through hole 47 extends in a vertical direction. The through hole 47 has a shape of a generally segment of a circle with its center being the rotation shaft 42.

Each of the pair of movable portion 45 is disposed at each side of the through hole 47 in the front-rear direction. The movable portion 45 protrudes leftward from a circumferential edge of each side of the through hole 47 in the front-rear direction. The movable portion 45 has a generally flat plate shape extending along the circumferential edge of the through hole 47 in the top-bottom direction. Each of the pair of movable portion 45 is coupled to each other along an upper side of the circumferential edge of the through hole 47. Each of the pair of movable portion 45 includes an inclined surface 45A and a parallel surface 45B.

The inclined surface 45A is disposed at a lower half of the movable portion 45. The inclined surface 45A extends leftward from the bottom to the top. A lower end portion of the inclined surface 45A continues to a left surface of the second arm 44.

The parallel surface 45B is disposed at an upper half of the movable portion 45. The parallel surface 45B is connected to an upper end portion of the inclined surface 45A. The parallel surface 45B extends upward from the upper end portion of the inclined surface 45A. The parallel surface 45B is parallel to the left surface of the second arm 44.

The main body coupling 38, as depicted in FIGS. 5 and 6, is supported by the main body coupling supporting shaft 51 to move in the left-right direction. The main body coupling 38 extends in the left-right direction. The main body coupling 38 has a generally tubular shape with a left end portion thereof open and a right end portion thereof closed. The main body coupling 38 is configured to move between an engaged position, e.g., an extended position (refer to FIGS. 5 and 12A) in which the main body coupling 38 is extended into the drum guide groove 30A of the inner frames 30, and a disengaged position, e.g., a retracted position (refer to FIGS. 11 and 12B) in which the main body coupling 38 retracts toward the left from the drum guide groove 30A of the inner frames 30. The main body coupling 38 includes a shaft portion 38A, an engagement protrusion 38B, and a flange portion 38C.

The shaft portion 38A extends in the left-right direction. The shaft portion 38A has a generally tubular shape with a left end portion thereof open and a right end portion thereof closed. The inside diameter of the shaft portion 38A is greater than the outside diameter of the main body coupling supporting shaft 51. The shaft portion 38A engages with the main body coupling supporting shaft 51 so as to move in the left-right direction. The shaft portion 38A is inserted into the through hole 47 of the cam 39 and the insertion hole 41A of the drum drive gear 41 such that an axial line of the shaft portion 38A matches an axial line of the drum drive gear 41. For example, the cam 39 is coupled to the shaft portion 38A of the main body coupling 38. A right end portion of the shaft portion 38A faces the drum guide groove 30A of the left inner frame 30 via a through hole (not depicted) of the left side plate 32 and the main body coupling insertion hole 30B of the left inner frame 30. The shaft portion 38A includes protrusions 38D.

Each protrusion 38D is disposed at respective end portions of the shaft portion 38A in the front-rear direction. Each protrusion 38D has a generally cylindrical shape protruding outward in a radial direction of the shaft portion 38A from an outer peripheral surface of the shaft portion 38A. Each protrusion 38D engages in a corresponding recess portion 41B of the drum drive gear 41 so as to move in the left-right direction but not to move in a circumferential direction of the drum drive gear 41. Thus, the main body coupling 38 is configured to rotate together with the drum drive gear 41.

Figure 8:
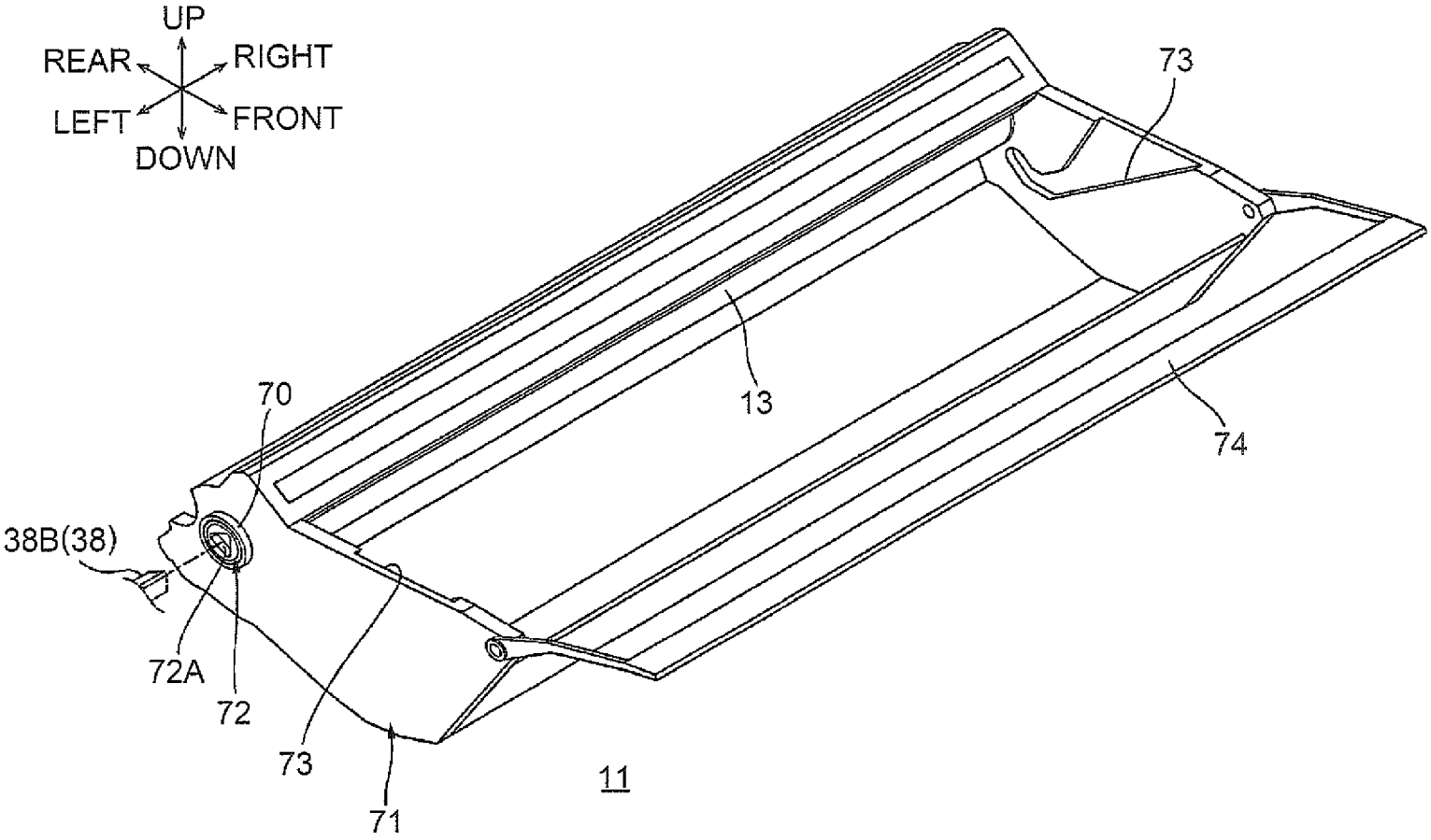
FIG. 8 is a perspective view of a drum cartridge depicted in FIG. 2.

As depicted in FIGS. 6 and 8, the engagement protrusion 38B is disposed at a right end portion of the main body coupling 38. The engagement protrusion 38B has a shape of a generally triangular prism extending rightward from a right end portion of the shaft portion 38A.

As depicted in FIG. 6, the flange portion 38C is disposed at a left end portion of the main body coupling 38. The flange portion 38C has a generally plate shape protruding outward in a radial direction of the shaft portion 38A from an outer peripheral surface of a left end portion of the shaft portion 38A and extending in a circumferential direction of the shaft portion 38A.

3. Details of Scanner Unit

As depicted in FIG. 2, the scanner unit 4 has a generally flat box shape. The scanner unit 4 includes a polygon mirror 56, an imaging lens 57, and a laser beam outlet 58.

The polygon mirror 56 is rotatably supported at a front end portion of the scanner unit 4. The polygon mirror 56 has a generally square flat plate shape in plan view. The polygon mirror 56 has a thickness in a vertical direction. The polygon mirror 56 is configured to reflect the laser beam L from a light source (not depicted) off a peripheral surface thereof while rotating, to direct the laser beam L toward the imaging lens 57.

The imaging lens 57 is disposed at a rear end portion of the scanner unit 4, to oppose the polygon mirror 56. The imaging lens 57 has a generally flat plate shape extending in the left-right direction. The imaging lens 57 has an f-theta characteristic in which the laser beam L deflected at an equiangular speed is modified to scan the photosensitive drum 13 at a constant speed.

The laser beam outlet 58 is disposed at a rear wall of the scanner unit 4, to oppose the imaging lens 57. The laser beam outlet 58 passes though the rear wall of the scanner unit 4 in the front-rear direction and extends in the left-right direction. The laser beam outlet 58 allows the laser beam L to pass therethrough.

4. Details of Drum Cartridge

As depicted in FIG. 8, the drum cartridge 11 has a generally rectangular frame shape in plan view. The drum cartridge 11 includes a drum frame 71, and a first coupling, a drum coupling 72.

The drum frame 71 has a generally rectangular frame shape in plan view. The drum frame 71 supports, at a front end portion thereof, the photosensitive drum 13, the scorotron charger 14 (refer to FIG. 1) and the transfer roller 15 (refer to FIG. 1). The drum frame 71 includes a coupling collar 70, guide grooves 73, and a grip 74.

The coupling collar 70 is disposed at a rear end portion of a left wall of the drum frame 71. The coupling collar 70 has a generally tubular shape protruding leftward from the left wall of the drum frame 71. A right end portion of the coupling collar 70 passes through the left wall of the drum frame 71.

Each guide groove 73 is disposed at a generally central portion of a corresponding one of right and left side walls of the drum frame 71 in the front-rear direction. Each guide groove 73 is recessed outward from an inner surface of a corresponding one of the right and left side walls of the drum frame 71, and extends downward from the front to the rear. Each guide groove 73 has a generally V shape in side view with an upper end portion thereof open.

The grip 74 is disposed at a front end portion of the drum frame 71. The grip 74 has a generally rectangular frame shape in plan view. The grip 74 is pivotally supported at rear end portions thereof by an upper front end portion of each right and left side wall of the drum frame 71.

The drum coupling 72 is supported at a left end portion of the photosensitive drum 13 to rotate together with the photosensitive drum 13. The drum coupling 72 is rotatably engaged in the coupling collar 70 of the drum frame 71. The drum coupling 72 has a generally cylindrical shape extending in the left-right direction. The drum coupling 72 is coaxial with the photosensitive drum 13. A left surface of the drum coupling 72 is exposed to the left via the coupling collar 70 of the drum frame 71. The drum coupling 72 includes an engagement recess 72A.

The engagement recess 72A is disposed at a central portion of the drum coupling 72 in a radial direction thereof. The engagement recess 72A is recessed rightward from the left surface of the drum coupling 72. The engagement recess 72A has a generally triangular shape in side view.

5. Drive Input to Process Cartridge

When the process cartridge 3 is mounted to the main body 2 and the top cover 8 is placed in the closed position, as depicted in FIG. 4, the cam 39 is placed in the release position. At this time, the shaft portion 38A of the main body coupling 38 is inserted into a lower end portion of the through hole 47 of the cam 39, and the flange portion 38C is disposed below the movable portion 45 of the cam 39.

Figure 12A:
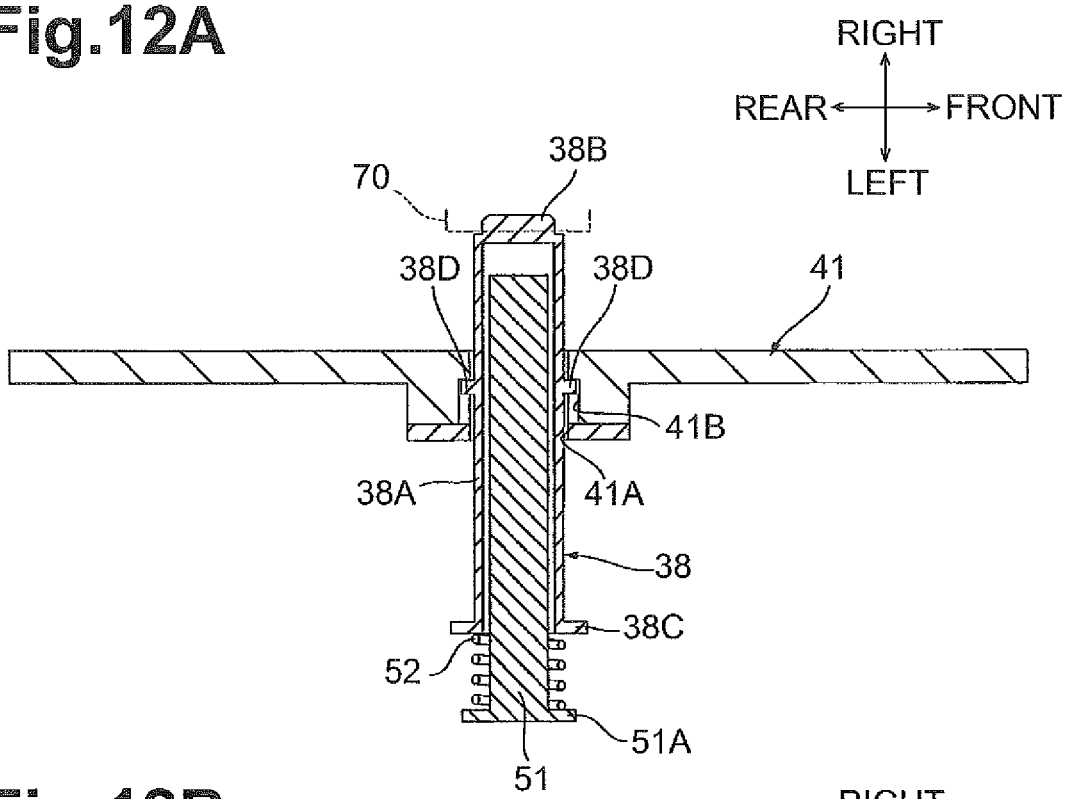
FIG. 12A is a sectional view of the drum drive gear and the main body coupling, taken along a line C-C in FIG. 4, in which the cam is omitted.

Thus, as depicted in FIGS. 5 and 12A, the main body coupling 38 is placed at the extended position by biasing force of the compression spring 52. The engagement protrusion 38B of the main body coupling 38 engages the engagement recess 72A of the drum coupling 72, as depicted by an imaginary line in FIG. 8.

In the above-described image forming operation, as the motor 36 is driven, the idle gears 40 sequentially rotate, so that drive force from the motor 36 is transmitted to the drum drive gear 41. Then, the drum drive gear 41 rotates.

Thereafter, the main body coupling 38 rotates together with the drum drive gear 41 about the axial line A1 coaxially with the drum gear 41.

The drum coupling 72 rotates together with the main body coupling 38 about the axial line A1 coaxially with the main body coupling 38. For example, the main body coupling 38 inputs drive force to the drum coupling 72. Then, the photosensitive drum 13 rotates.

Thus, drive force from the motor 36 of the main body 2 is input to the process cartridge 3.

6. Mounting and Removing of Process Cartridge

Mounting and removal operation of the process cartridge 3 will be described.

Figure 9:
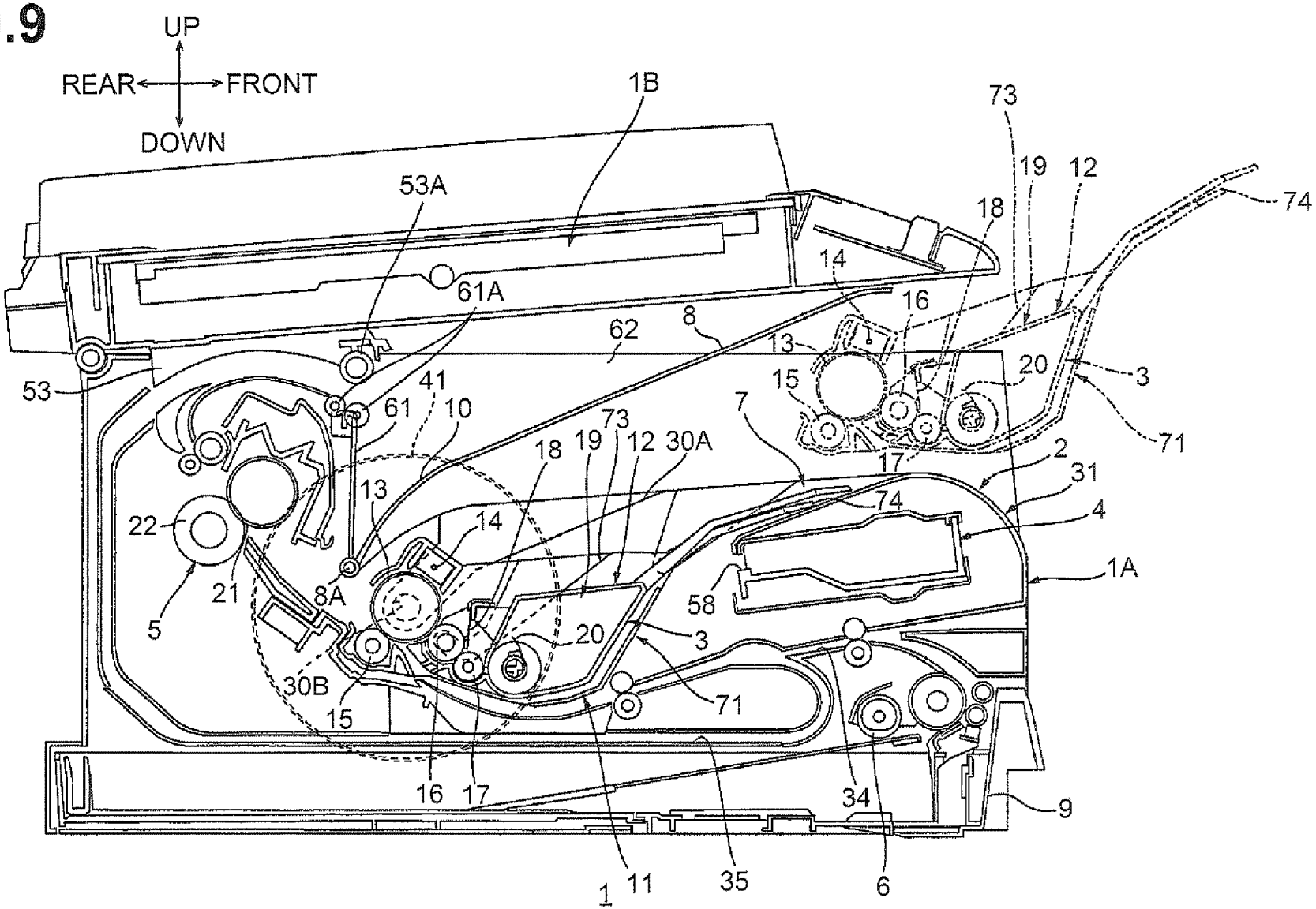
FIG. 9 is a side sectional view of the printer with a top cover being in an open position to mount or remove a process cartridge.

To remove the process cartridge 3 that is mounted on the main body 2 and is positioned in the inside position, an operator raises a front end portion of the top cover 8 placed in the closed position, so that the top cover 8 is placed in the open position, as depicted in FIG. 9.

At this time, the top cover 8 pivots counterclockwise about the pivot shaft 8A in left side view. As the top cover 8 pivots, the front end portion of the link member 46 rises upward, and slides upward, in a direction in which the raised link member 46 extends, with respect to the first arm 43 of the cam 39.

Accordingly, an inner peripheral edge below the elongated hole 46A of the raised link member 46 comes into contact with the boss 46B of the first arm 43 from below.

Figure 10:
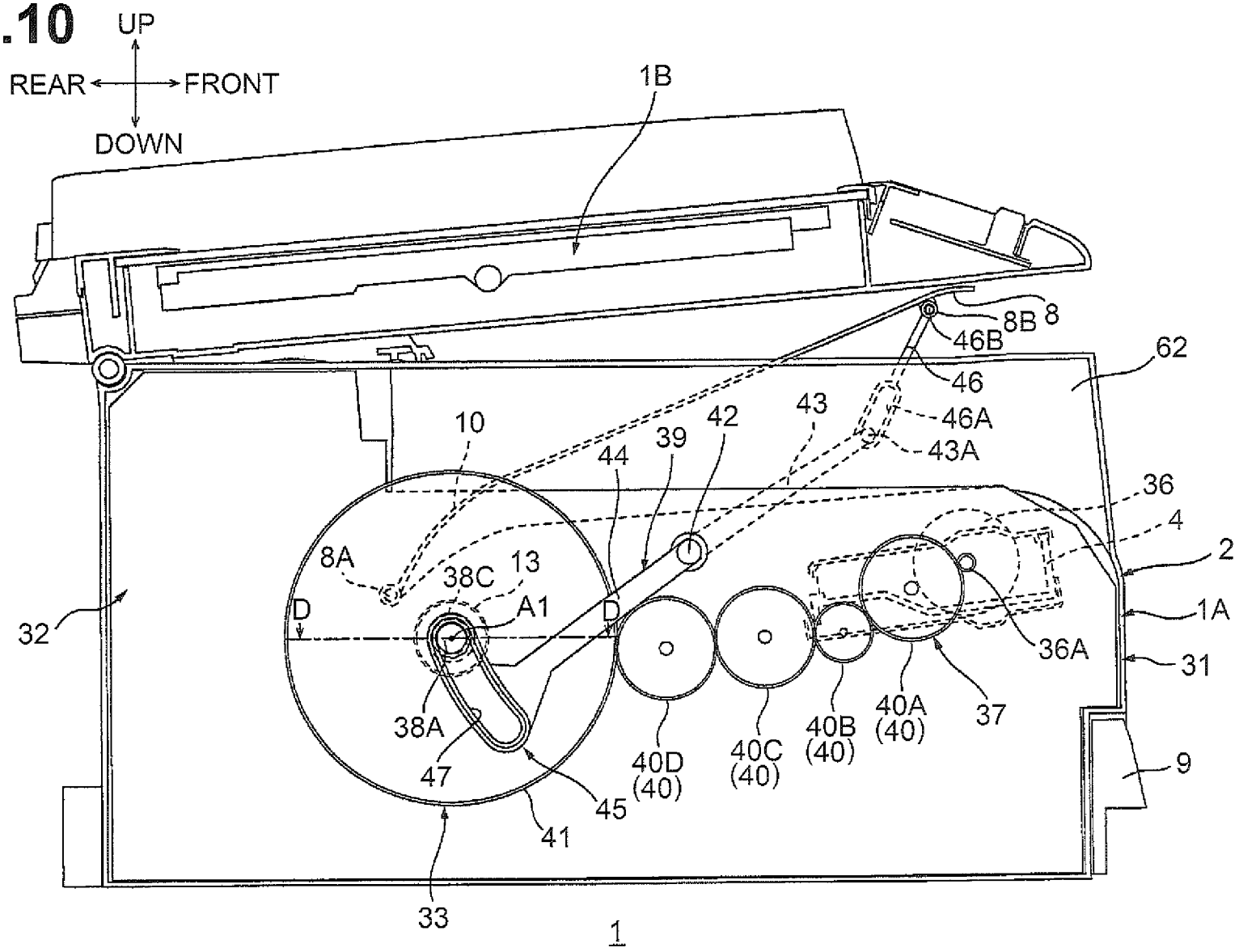
FIG. 10 is a sectional view of the printer, taken along a line B-B in FIG. 3, when the top cover is in the open position and the cam is in a pressing position.

Then, when the top cover 8 further pivots, the first arm 43 of the cam 39 is pulled upward along with the top cover 8 via the link member 46, as depicted in FIG. 10.

Then, the cam 39 rotates counterclockwise about the rotation shaft 42 in left side view, and is placed in the pressing position.

Figure 11:
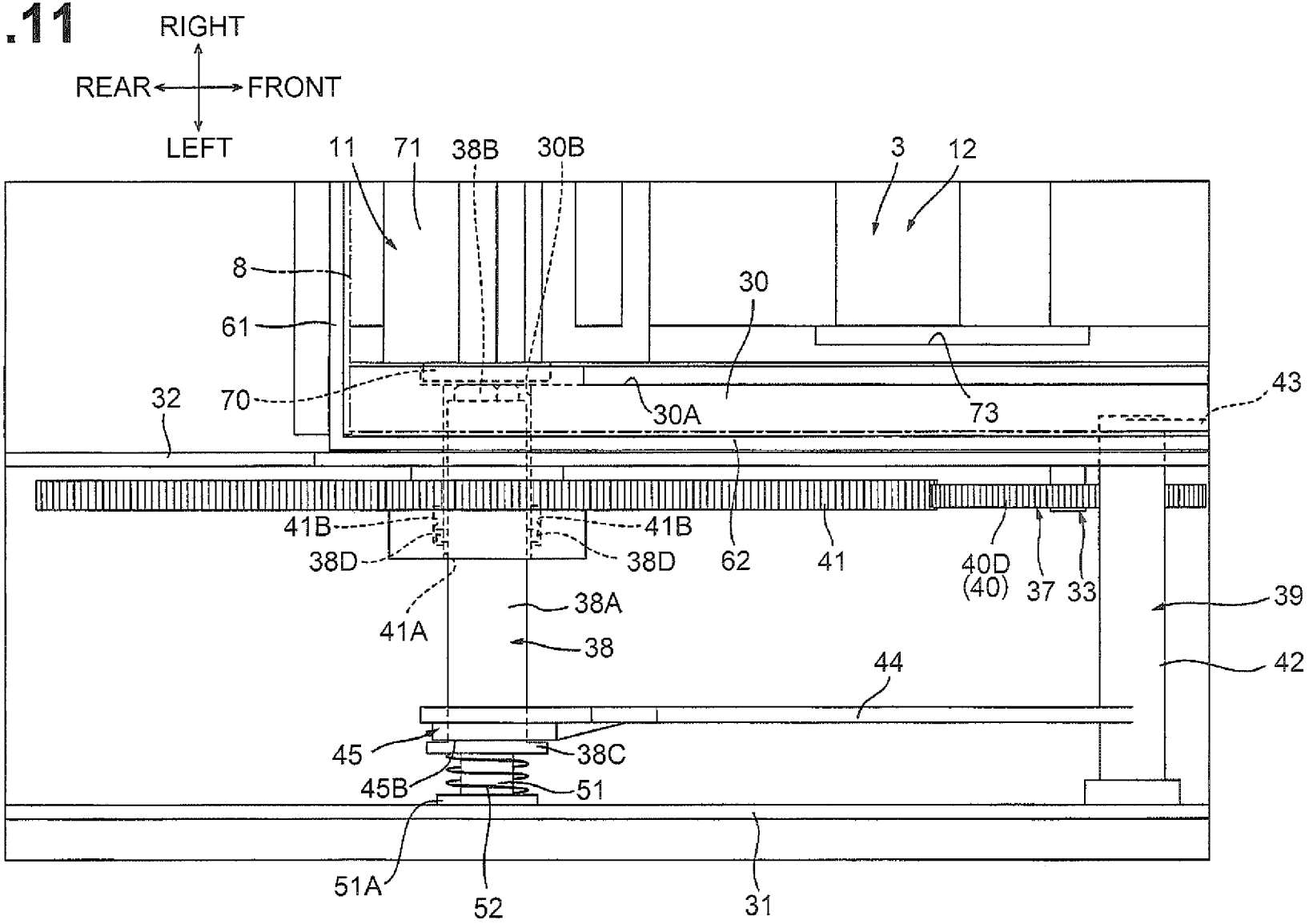
FIG. 11 is an enlarged view of a particular portion depicted in FIG. 3, in which the main body coupling is in a retracted position.
Figure 12B:
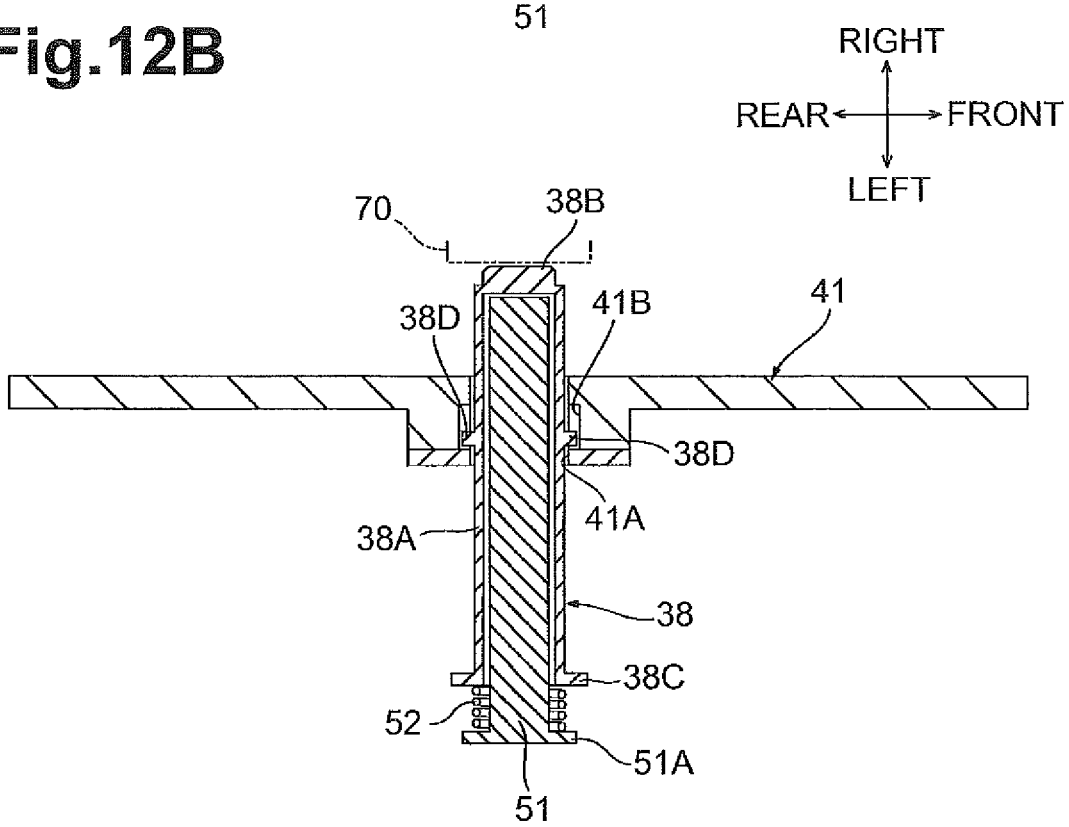
FIG. 12B is a sectional view of the drum drive gear and the main body coupling, taken along a line D-D in FIG. 10, in which the cam is omitted.

At this time, as the flange portion 38C, as depicted in FIGS. 11 and 12B, slidably moves upward and leftward along the inclined surface 45A of the movable portion 45 of the cam 39, the flange portion 38C contacts the parallel surface 45B of the movable portion 45 of the cam 39. Thus, the main body coupling 38 is placed in the retracted position. That is to say, the cam 39 positions the main body coupling 38 to the retracted position in response to movement of the top cover 8 from the closed position to the open position.

Then, the engagement protrusion 38B of the main body coupling 38 moves leftward to separate from the engagement recess 72A of the drum coupling 72. Thus, the engagement protrusion 38B of the main body coupling 38 is disengaged from the engagement recess 72A of the drum coupling 72.

Then, an operator pulls the process cartridge 3 upward and frontward, as depicted by an imaginary line in FIG. 9, while holding the grip 74.

Then, the process cartridge 3 is removed from the main body 2, via the main body opening 7, and is positioned in the outside position.

Thus, an operation of removing the process cartridge 3 from the main body 2 completes.

To mount the process cartridge 3 to the main body 2, an operator may move or handle the main body 2 and the process cartridge 3 in a reverse procedure to the above-described removing operation.

In one example, while holding the grip 74, an operator inserts the process cartridge 3 into the main body opening 7 such that the coupling collar 70 engages in the drum guide groove 30A.

Then, an operator pushes the process cartridge 3 downward and rearward until the coupling collar 70 engages in a lower rear end portion of the drum guide groove 30A. The process cartridge 3 is positioned in the inside position, as depicted in FIG. 1.

Thereafter, the drum coupling 72 faces the main body coupling 38 via the main body coupling insertion hole 30B, with the coupling collar 70 engaged in the lower rear end portion of the drum guide groove 30A.

Then, an operator moves down a front end portion of the top cover 8, which is placed in the open position, so that the top cover 8 is placed in the closed position.

At this time, the top cover 8 pivots clockwise about the pivot shaft 8A in left side view. As the top cover 8 pivots, the link member 46 slides downward, in a direction in which the raised link member 46 extends, with respect to the first arm 43 of the cam 39.

Accordingly, an inner peripheral edge above the elongated hole 46A of the raised link member 46 comes into contact with the boss 46B of the first arm 43 from above.

Then, when the top cover 8 further pivots, as depicted in FIG. 4, the first arm 43 of the cam 39 is moved down via the link member 46 along with the top cover 8.

Then, the cam 39 rotates clockwise about the rotation shaft 42 in left side view, and is placed in the release position.

At this time, the flange portion 38C, as depicted in FIGS. 5 and 12A, slidably moves downward and rightward along the inclined surface 45A of the movable portion 45 of the cam 39, and is placed below the movable portion 45 of the cam 39. Thus, the main body coupling 38 is placed in the extended position. That is to say, the cam 39 positions the main body coupling 38 to the extended position in response to movement of the top cover 8 from the open position to the closed position.

Then, the engagement protrusion 38B of the main body coupling 38 enters the engagement recess 72A of the drum coupling 72. Thus, the engagement protrusion 38B of the main body coupling 38 engages in the engagement recess 72A of the drum coupling 72.

As the cam 39 rotates and the top cover 8 pivots, an upper end portion of the raised link member 46 is inclined frontward.

Thus, an operation of mounting the process cartridge 3 to the main body 2 completes.

6. Effects (1) In the printer 1, as depicted in FIGS. 4 and 5, drive force from the motor 36 is input to the drum drive gear 41 via the idle gears 40, and transmitted to the drum coupling 72 via the main body coupling 38, to rotate the photosensitive drum 13.

As depicted in FIG. 4, the drum drive gear 41 overlaps with the discharge tray 10 when viewed from the left-right direction.

Accordingly, the discharge tray 10 may be disposed closer to the photosensitive drum 13.

Consequently, a physical size of the printer 1 may be reduced.

Further, in the printer 1, the drum drive gear 41 may be structured large enough to overlap with the discharge tray 10, relative to the photosensitive drum 13, when viewed from the left-right direction.

Accordingly, changes in rotation speed of the photosensitive drum 13 attributable to dimensional tolerances of the gear teeth of the drum drive gear 41 may be reduced.

Consequently, color unevenness in a printed image may be reduced or prevented.

A spatial frequency of an image having color unevenness attributable dimensional tolerances of the gear teeth of the drum drive gear 41 may be higher than a spatial frequency of a readily-visible image.

Consequently, color unevenness in a printed image may be made less noticeable.

(2) In the printer 1, the drum drive gear 41, as depicted in FIG. 5, is disposed to the left of the discharge tray 10.

Therefore, interference of a sheet P placed on the discharge tray 10 with the drum drive gear 41 may be prevented or reduced.

(3) In the printer 1, the movable portion 45 of the cam 39 is disposed to the left of the drum drive gear 41, as depicted in FIG. 5.

Therefore, as compared with a case in which the movable portion 45 of the cam 39 is disposed to the right of the drum drive gear 41, interference of components disposed on a periphery of the photosensitive drum 13 with the movable portion 45 of the cam 39 may be prevented or reduced.

Consequently, flexibility of arrangement of components on a periphery of the photosensitive drum 13 may be ensured.

(4) In the printer 1, the top cover 8 serves as a bottom wall of the discharge tray 10, as depicted in FIG. 2.

Therefore, as compared with a case in which the top cover 8 and the discharge tray 10 are separately provided, the number of components may be reduced.

(5) In the printer 1, a bottom wall of the discharge tray 10, e.g., the top cover 8, may be pivotally moved to open or close the main body opening 7 of the main body 2, as depicted in FIG. 9.

Thus, the main body opening 7 of the main body 2 may be opened or closed with a simple structure.

As compared with a case in which the whole discharge tray 10 is pivotally moved, the top cover 8 may be pivotally moved greatly by a dimension of the side wall 62 in a vertical direction.

(6) In the printer 1, as depicted in FIG. 4, the pivot shaft 8A of the top cover 8 overlaps with the drum drive gear 41 when viewed from the left-right direction.

Therefore, in such a structure that the top cover 8 serves as a bottom wall of the discharge tray 10, the top cover 8 may be disposed closer to the photosensitive drum 13.

Consequently, a physical size of the printer 1 may further be reduced.

(7) In the printer 1, as depicted in FIG. 3, the first arm 43 of the cam 39 and the link member 46 are disposed to the right of the left side wall 62 of the discharge tray 10.

Therefore, in such a structure that the top cover 8 serves as a bottom wall of the discharge tray 10, the first arm 43 of the cam 39 may be coupled to the top cover 8 via the link member 46, with a simple structure.

The top cover 8 and the cam 39 may be coupled at a position closer to the center of the main body 2 in the left-right direction than the left side wall 62. Therefore, in such a structure that the top cover 8 serves as a bottom wall of the discharge tray 10, the size of the top cover 8 in the left-right direction may be reduced.

Thus, the top cover 8 may be disposed between the side walls 62.

(8) In the printer 1, as depicted in FIGS. 4 and 10, the cam 39 is configured to be pivotally moved about the rotation shaft 42 connecting the first arm 43 and the second arm 44.

Therefore, the first arm 43 coupled to the top cover 8 and the movable portion 45 may be moved with a simple structure, by pivotally moving the cam 39 about the rotation shaft 42.

The rotation shaft 42 connects the first arm 43 and the second arm 44. Therefore, strength of a portion connecting the first arm 43 and the second arm 44 may be ensured.

The cam 39 may be pivotally moved within a relatively small space, without moving a portion connecting the first arm 43 and the second arm 44, e.g., the rotation shaft 42. Thus, flexibility in arrangement of components near the cam 39 may be ensured.

(9) In the printer 1, as depicted in FIG. 3, the rotation shaft 42 connects the first arm 43 and the second arm 44 such that drive force is transmitted from the first arm 43 to the second arm 44 via the rotation shaft 42.

Therefore, when the second arm 44 including the movable portion 45 is disposed to the left of the drum drive gear 41 and the first arm 43 coupled to the top cover 8 is disposed to the right of the left side wall 62 of the discharge tray 10, force to open the top cover 8 is transmitted to the movable portion 45, via the first arm 43, the rotation shaft 42, and the second arm 44.

(10) In the printer 1, as depicted in FIG. 4, the rotation shaft 42 is disposed further to the front than the drum drive gear 41 when viewed from the left-right direction, to prevent the rotation shaft 42 from overlapping with the drum drive gear 41.

Thus, a space between the rotation shaft 42 and the main body coupling 38 in the front-rear direction may be ensured.

Accordingly, a movement amount of the movable portion 45 when the cam 39 is rotated about the rotation shaft 42 may be ensured.

Especially, a movement amount of the movable portion 45 may be ensured while a movement amount of the top cover 8 from the closed position to the open position is reduced.

Consequently, the main body coupling 38 may be reliably moved, so that the drum coupling 72 and the main body coupling 38 may be reliably disengaged.

(11) In the printer 1, as depicted in FIG. 2, the drum drive gear 41 overlaps with the duplex print path 35 when viewed from the left-right direction.

Accordingly, the duplex print path 35 may be disposed closer to the photosensitive drum 13.

Consequently, a physical size of the printer 1 may further be reduced.

(12) In the printer 1, as depicted in FIG. 2, the drum drive gear 41 overlaps with the sheet supply tray 9 when viewed from the left-right direction.

Accordingly, the sheet supply tray 9 may be disposed closer to the photosensitive drum 13.

Consequently, a physical size of the printer 1 may further be reduced.

(13) In the printer 1, the motor 36 is disposed to the left of the scanner unit 4, as depicted in FIG. 3.

Therefore, the motor 36 may be disposed efficiently using a space to the left of the scanner unit 4.

Consequently, a physical size of the printer 1 may further be reduced.

(14) In the printer 1, as depicted in FIGS. 3 and 4, the motor 36 overlaps with the scanner unit 4 when viewed from the left-right direction, and overlaps with a left front end portion of the top cover 8 when projected in a vertical direction.

Therefore, the motor 36 may be disposed closer to the scanner unit 4 in an area overlapping with the top cover 8 in a vertical direction.

Consequently, a physical size of the printer 1 may be reduced further more.

(15) In the printer 1, as depicted in FIG. 2, the scanner unit 4 overlaps with the pickup roller 6 when projected in a vertical direction.

The pickup roller 6 may be disposed in an area overlapping with the scanner unit 4 in a vertical direction.

Consequently, a physical size of the printer 1 may further be reduced.

(16) In the printer 1, the drum drive gear 41 is disposed to the left of the left side wall 62 of the discharge tray 10, as depicted in FIG. 3.

The drum drive gear 41 may be disposed efficiently using a space to the left of the discharge tray 10.

Consequently, a physical size of the printer 1 may be reduced.

Further, in the printer 1, the drum drive gear 41 may be structured large relative to the photosensitive drum 13.

Therefore, changes in the rotation speed of the photosensitive drum 13 attributable to dimensional tolerances of the gear teeth of the drum drive gear 41 may be reduced.

Consequently, occurrences of color unevenness in a printed image may be reduced or prevented.

A spatial frequency of an image having color unevenness attributable to dimensional tolerances of the gear teeth of the drum drive gear 41 may be higher than a spatial frequency of a readily visible image.

Consequently, color unevenness in a printed image may be made less noticeable.

(17) In the printer 1, as depicted in FIG. 2, the drum drive gear 41 overlaps with a lower end portion of the rear wall 61 when viewed from the left-right direction.

Thus, the drum drive gear 41 may be structured large relative to the photosensitive drum 13, to overlap with the rear wall 61 when viewed from the left-right direction.

Therefore, changes in the rotation speed of the photosensitive drum 13 attributable to dimensional tolerances of the gear teeth of the drum drive gear 41 may be reduced.

Consequently, occurrences of color unevenness in a printed image may be reduced or prevented.

A spatial frequency of an image having color unevenness attributable to dimensional tolerances of the gear teeth of the drum drive gear 41 may be higher than a spatial frequency of a readily visible image.

Consequently, color unevenness in a printed image may be made less noticeable.

(18) In the printer 1, as depicted in FIG. 10, the cam 39 rotates about the rotation shaft 42 connecting the first arm 43 and the second arm 44. A position of the pivot shaft 42 may not be changed.

At this time, if a rotation center is provided outside a portion connecting the first arm 43 and the second arm 44, a position of the portion connecting the first arm 43 and the second arm 44 may be changed, as the cam 39 rotates.

Consequently, if the rotation center is provided outside the portion connecting the first arm 43 and the second arm 44, a space to move the portion connecting the first arm 43 and the second arm 44 may be necessary, and other components cannot be provided in the space.

However, in the printer 1, because the portion connecting the first arm 43 and the second arm 44 functions as the rotation shaft 42, the space to move the portion connecting the first arm 43 and the second arm 44 may not be necessary, and the cam 39 may be pivotally moved within a relatively small space.

Thus, the cam 39 and peripheral components of the cam 39 may be disposed efficiently.

Furthermore, as depicted in FIG. 3, the first arm 43 to be coupled to the top cover 8 extends from the right end portion of the rotation shaft 42 of the cam 39. The second arm 44 to be coupled to the main body coupling 38 extends from the left end portion of the rotation shaft 42 of the cam 39.

Therefore, a left end portion of the top cover 8 may be disposed rightward so as to substantially match the left end portion of the top cover 8, and the first arm 43 may be coupled to the left end portion of the top cover 8 via the link member 46.

Consequently, a physical size of the top cover 8 may be reduced.

Furthermore, the second arm 44 may be coupled to the main body coupling 38 to the left of the top cover 8.

Thus, the main body coupling 38 may be moved in conjunction with movement of the top cover 8.

Consequently, the main body coupling 38 may be moved in the left-right direction in conjunction with movement of the top cover 8, while a physical size of the printer 1 may further be reduced.

(19) In the printer 1, as depicted in FIG. 1, the image reading portion 1B is disposed to cover the discharge tray 10 from above. The discharge tray 10 has the top cover 8 as a bottom wall and has a generally frame shape with the side walls 62 at both side of the top cover 8 in the left-right direction.

Therefore, the sheet P may be discharged into a space defined by the image reading portion 1B, the side walls 62 and the top cover 8, and may be placed on the top cover 8.

Thus, the sheet P discharged outside the main body 2 may be placed by using the top cover 8, without separately setting a configuration to place the sheet P.

Further, the top cover 8 may move by itself, independently from the side walls 62, between the open position and the closed position.

Therefore, in a case in which the image reading portion 1B is disposed above the discharge tray 10 and a moving range of the top cover 8 is restricted, the top cover 8 may be moved significantly, as compared with a case in which the side walls 62 and the top cover 8 move together.

(20) In the printer 1, as depicted in FIG. 4, the distance D1 between the axial line A2 of the rotation shaft 42 of the cam 39 and the axial line A1 of the main body coupling 38 is longer than the distance D2 between the axial line A3 of the pivot shaft 8A of the top cover 8 and the axial line A1 of the main body coupling 38.

Therefore, a distance between the rotation shaft 42 of the cam 39 and the main body coupling 38 may be ensured while the pivot shaft 8A of the top cover 8 and the main body coupling 38 are disposed adjacently.

Thus, a movement amount of the second arm 44 may be ensured while a movement amount of the top cover 8 is reduced.

Consequently, the main body coupling 38 may be reliably moved, so that the drum coupling 72 and the main body coupling 38 may be reliably disengaged.

(21) In the printer 1, as depicted in FIG. 10, the first arm 43 of the cam 39 is connected to the top cover 8 via the link member 46.

At this time, the pivot shaft 8A of the top cover 8 is disposed at a different position from the rotation shaft 42 of the cam 39. Therefore, a moving locus of the top cover 8 may be different from a moving locus of the first arm 43.

However, in the printer 1, the link member 46 is connected to the first arm 43 in the elongated hole 46A so as to slide in a direction connecting the boss 46B and the elongated hole 46A.

Therefore, when the top cover 8 pivots, even if the distance between the top cover 8 and the first arm 43 is changed on the grounds that the moving locus of the top cover 8 is different from the moving locus of the first arm 43, the link member 46 may slide with respect to the first arm 43 to allow the distance between the top cover 8 and the first arm 43 to change.

Consequently, even if the pivot shaft 8A of the top cover 8 is disposed at a different position from the rotation shaft 42 of the cam 39, the cam 39 may rotate smoothly in conjunction with pivot of the top cover 8.

(22) In the printer 1, as depicted in FIG. 3, the first arm 43 is disposed to the right of the left end portion of the top cover 10.

Therefore, the top cover 8 may be coupled to the cam 39 to the right of the left end portion of the top cover 10.

Consequently, the size of the top cover 8 in the left-right direction may be reduced.

Figure 13:
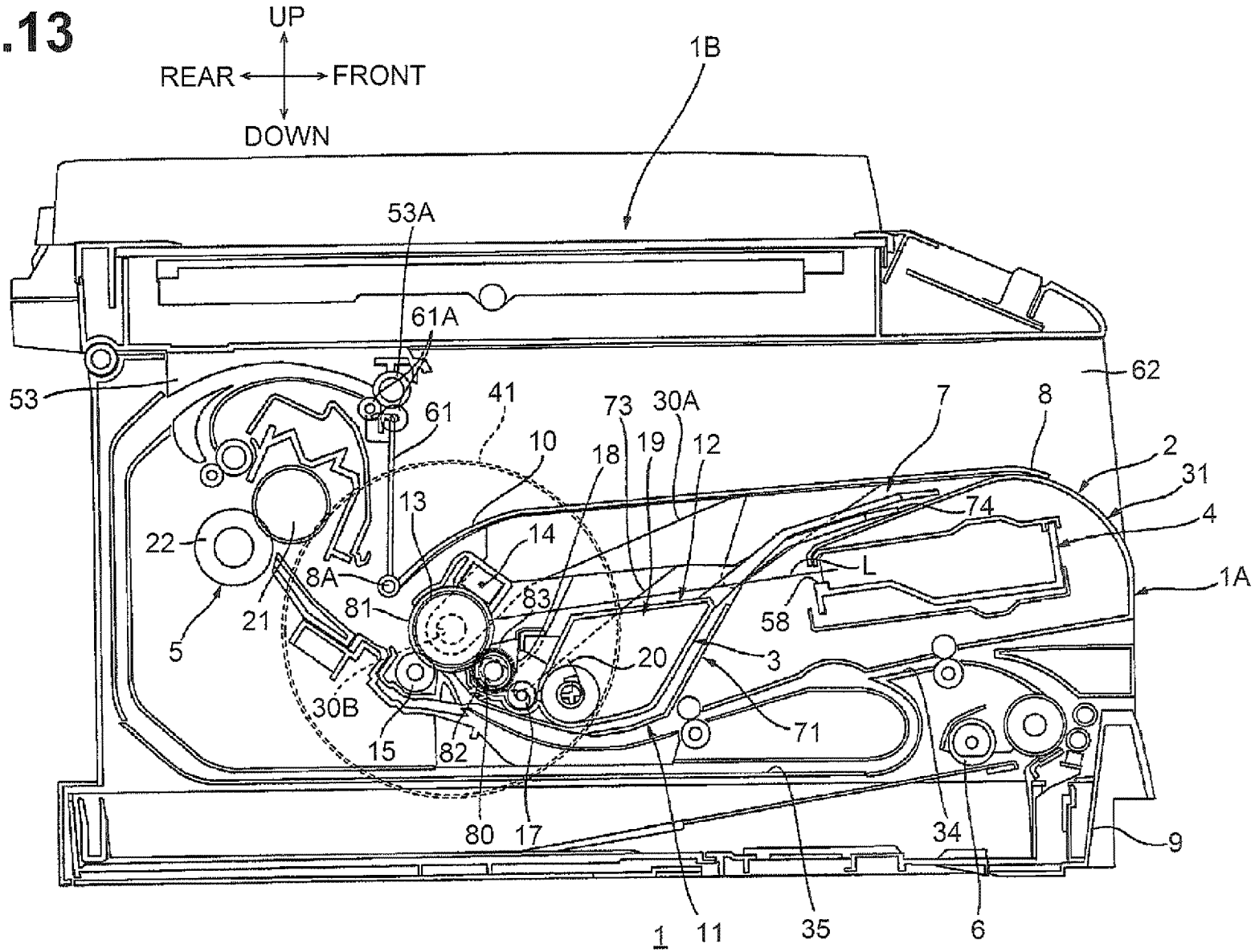
FIG. 13 is a side sectional view of an image forming apparatus according to a modification of an illustrative embodiment according to one or more aspects of the disclosure.

7. Modification (1) In the above-described illustrative embodiment, the developing roller 16 is configured to supply toner to the photosensitive drum 13. In another embodiment, as depicted in FIG. 13, a developing brush 80 may include a brush 83 disposed at a surface thereof. The developing brush 80 may be configured to supply toner to the photosensitive drum 13.

In another embodiment, a gear portion 81 including gear teeth may be disposed at a peripheral surface of the drum coupling 72 of the photosensitive drum 13. The gear portion 81 may be configured to engage a drive gear 82 of the developing brush 80. In this case, drive force from the motor 36 may be transmitted to the developing brush 80 via the drum coupling 72.

This modification may obtain effects similar to those obtained in the above-described illustrative embodiment.

Figure 14:
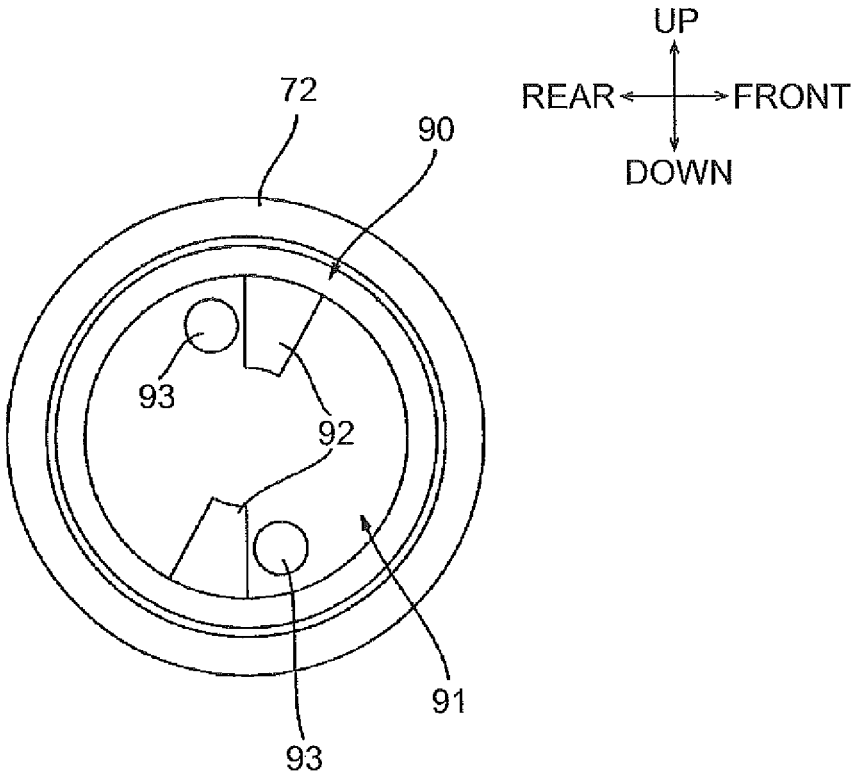
FIG. 14 is a plan view of a drum coupling according to a modification of an illustrative embodiment according to one or more aspects of the disclosure.

(2) In the above-described illustrative embodiment, the drum coupling 72 includes the engagement recess 72A having a generally triangular shape in side view, as depicted in FIG. 14. In another embodiment, a drum coupling 90 may include an engagement recess 91 having a generally circular shape in side view and protrusions 92 protruding inwardly from an inner peripheral surface of the engagement recess 91 in a radial direction thereof.

In this case, the main body coupling 38 may include protrusions 93 protruding rightward from a right end portion of the coupling 38. Each protrusion 93 may be configured to contact a corresponding protrusion 92.

This modification may obtain effects similar to those obtained in the above-described illustrative embodiment.

(3) In the above-described illustrative embodiment, the parallel surface 45B of the movable portion 45 of the cam 39 contacts the flange portion 38C of the main body coupling 38, to disengage the engagement protrusion 38B of the main body coupling 38 from the engagement recess 72A of the drum coupling 72. Accordingly, the main body coupling 38 is pressed leftward away from the drum coupling 72.

In another embodiment, to engage the engagement protrusion 38B of the main body coupling 38 with the engagement recess 72A of the drum coupling 72, for example, the flange portion 38C of the main body coupling 38 may be brought into contact with the parallel surface 45B of the movable portion 45 of the cam 39 such that the main body coupling 38 may be pressed rightward toward the drum coupling 72. In this case, the second arm 44 may be disposed between the flange portion 51A of the main body coupling supporting shaft 51 and the flange portion 38C of the main body coupling 38. The compression spring 52 may be disposed between the flange portion 38C and the drum drive gear 41 in a compressed state. To disengage the engagement protrusion 38B of the main body coupling 38 from the engagement recess 72A of the drum coupling 72, pressure applied to the main body coupling 38 may be released.

(4) In the above-described illustrative embodiment, the drum drive gear 41 and the main body coupling 38 are separate members. In another embodiment, the drum drive gear 41 and the main body coupling 38 may be formed integrally.

(5) In the above-described illustrative embodiment, the process cartridge 3 including the drum cartridge 11 and the developing cartridge 12 configured to be removably mounted to the drum cartridge 11, is given as an example of a cartridge. In another embodiment, a process cartridge including a drum unit including a photosensitive drum, and a developing unit configured to supply toner to the photosensitive drum and integrally formed with the drum unit may be an example of a cartridge.

(6) In the above-described illustrative embodiment, the photosensitive drum 13 is given as an example of an image carrier. In another embodiment, a photosensitive belt may be an image carrier. Further, in the above-described illustrative embodiment, the photosensitive drum 13 is given as an example of a rotating member. In another embodiment, such as a developing roller 16 and a supply roller 17, which are configured to carry toner, may be a rotating member.

(7) In the above-described illustrative embodiment, the link member 46 includes the elongated hole 46A. However, the configuration in which the link member 46 slides with respect to the first arm 43 is not limited. For example, a rail in which the boss 46A of the first arm 43 engages may be provided in the link member 46. In another embodiment, a boss may be provided on the link member 46, and an elongated hole or a rail in which the boss of the link member 46 engages may be provided in the first arm 43.

(8) In the above-described illustrative embodiment, the drive unit 33 is disposed outside each side wall 62 in the left-right direction. In another embodiment, a switch, an indicator and so on (not depicted) may be disposed.

What is claimed is:

1. An image forming apparatus comprising:

a main body including a drive source; and a cartridge including an image carrier configured to carry a developer image thereon and a first coupling configured to rotate the image carrier, and configured to be mounted to and removed from the main body, wherein the main body includes:

a second coupling configured to engage with and disengage from the first coupling, the second coupling configured to rotate together with the first coupling about a rotation axis coaxially with the first coupling when the second coupling engages with the first coupling;

a rotator including gear teeth disposed on a peripheral surface thereof, and configured to rotate the second coupling in response to receiving the drive force from the drive source and to rotate together with the second coupling about the rotation axis coaxially with the second coupling;

a receiving member configured to receive a recording medium discharged outside the main body;

an accommodating member configured to accommodate the recording medium to be supplied to the image carrier; and a refeeding portion configured to feed the recording medium having the developer image from the image carrier fixed thereon, to the image carrier again, and the refeeding portion includes a first path extending downwardly and a second path extending continuously from the first path along an upper end of the accommodating member, wherein an upper end of the rotator is positioned at a first position in a first height range from the bottom of the main body and a lower end of the rotator is positioned at a second position in a second height range from the bottom of the main body, wherein a portion of the second path of the refeeding portion is positioned lower than the first position and higher than the second position, and positioned lower than the receiving member; and wherein the receiving member is entirely positioned lower than the first position and higher than the second position.

2. The image forming apparatus according to claim 1, wherein the second path extends horizontally.

3. The image forming apparatus according to claim 1, wherein the first path extends vertically.

4. The image forming apparatus according to claim 1, further comprising an exposure member configured to expose the image carrier to light to form an electrostatic latent image on a surface of the image carrier, wherein the rotator is positioned between the exposure member and the first path.

5. The image forming apparatus according to claim 4, wherein the exposure member is configured to expose the image carrier to light substantially horizontally.

6. The image forming apparatus according to claim 4, wherein the exposure member does not overlap with the rotator in a vertical direction.

7. The image forming apparatus according to claim 1, wherein the cartridge is entirely positioned lower than the first position and higher than the second position.

8. The image forming apparatus according to claim 1, wherein the image carrier is a photosensitive drum.

9. The image forming apparatus according to claim 1, wherein a diameter of the rotator is more than half of the height of the main body.

10. An image forming apparatus comprising:

a main body including a drive source;

a cartridge including an image carrier configured to carry a developer image thereon and a first coupling configured to rotate the image carrier, and configured to be mounted to and removed from the main body; and an exposure member configured to expose the image carrier to light to form an electrostatic latent image on a surface of the image carrier, wherein the main body includes:

a second coupling configured to engage with and disengage from the first coupling, the second coupling configured to rotate together with the first coupling about a rotation axis coaxially with the first coupling when the second coupling engages with the first coupling;

a rotator including gear teeth disposed on a peripheral surface thereof, and configured to rotate the second coupling in response to receiving the drive force from the drive source and to rotate together with the second coupling about the rotation axis coaxially with the second coupling;

a receiving member configured to receive a recording medium discharged outside the main body;

an accommodating member configured to accommodate the recording medium to be supplied to the image carrier; and a refeeding portion configured to feed the recording medium having the developer image from the image carrier fixed thereon, to the image carrier again, and the refeeding portion includes a first path extending downwardly and a second path extending continuously from the first path along an upper end of the accommodating member, wherein the rotator is positioned between the exposure member and the first path, wherein when viewed from the rotation axis, a portion of the second path of the refeeding portion overlaps with the rotator.

11. The image forming apparatus according to claim 10, wherein when viewed from the rotation axis, the first path does not overlap with the rotator.

12. The image forming apparatus according to claim 10, wherein the second path extends horizontally.

13. The image forming apparatus according to claim 10, wherein the first path extends vertically.

14. The image forming apparatus according to claim 10, wherein the image carrier is a photosensitive drum.

15. The image forming apparatus according to claim 10, wherein a diameter of the rotator is more than half of the height of the main body.

16. An image forming apparatus comprising:

a main body including a drive source; and a cartridge including an image carrier configured to carry a developer image thereon and a first coupling configured to rotate the image carrier, and configured to be mounted to and removed from the main body, wherein the main body includes:

a second coupling configured to engage with and disengage from the first coupling, the second coupling configured to rotate together with the first coupling about a rotation axis coaxially with the first coupling when the second coupling engages with the first coupling;

a rotator including gear teeth disposed on a peripheral surface thereof, and configured to rotate the second coupling in response to receiving the drive force from the drive source and to rotate together with the second coupling about the rotation axis coaxially with the second coupling;

a receiving member configured to receive a recording medium discharged outside the main body;

an accommodating member configured to accommodate the recording medium to be supplied to the image carrier; and a refeeding portion configured to feed the recording medium having the developer image from the image carrier fixed thereon, to the image carrier again, and the refeeding portion includes a first path extending downwardly and a second path extending continuously from the first path along an upper end of the accommodating member, wherein an upper end of the rotator is positioned at a first position in a first height range from the bottom of the main body and a lower end of the rotator is positioned at a second position in a second height range from the bottom of the main body, wherein a portion of the second path of the refeeding portion is positioned lower than the first position and higher than the second position, and positioned lower than the receiving member, and wherein the cartridge is entirely positioned lower than the first position and higher than the second position.

17. The image forming apparatus according to claim 16, wherein the receiving member is entirely positioned lower than the first position and higher than the second position.

18. The image forming apparatus according to claim 16, further comprising an exposure member configured to expose the image carrier to light to form an electrostatic latent image on a surface of the image carrier, wherein the rotator is positioned between the exposure member and the first path.

19. The image forming apparatus according to claim 18, wherein the exposure member is configured to expose the image carrier to light substantially horizontally.

20. The image forming apparatus according to claim 18, wherein the exposure member does not overlap with the rotator in a vertical direction.

* * * * *